US012102903B2

(12) United States Patent
Churchman et al.

(10) Patent No.: US 12,102,903 B2
(45) Date of Patent: Oct. 1, 2024

(54) AMBULATION SIMULATION SYSTEMS, TERRAIN SIMULATION SYSTEMS, TREADMILL SYSTEMS, AND RELATED SYSTEMS AND METHODS

(71) Applicant: XPRNC Inc., Belleville, NJ (US)

(72) Inventors: Stephen Joseph Churchman, Hamilton, NJ (US); Alexander David Metzger, Englewood, NJ (US); Jason Michael Becker, Holbrook, NY (US); Marcus Raman, Park Ridge, NJ (US); Sreenivas Raman, Park Ridge, NJ (US); Manolo A. Duenas Benavidez, Brentwood, NY (US); Victor Schiott Bech-Hansen, Califon, NJ (US); Clark Richard Smiley, Ashburn, VA (US); Michael James White, Ashburn, VA (US)

(73) Assignee: XPRNC Inc., Belleville, NJ (US)

( * ) Notice: Subject to any disclaimer, the term of this patent is extended or adjusted under 35 U.S.C. 154(b) by 67 days.

(21) Appl. No.: 17/962,900

(22) Filed: Oct. 10, 2022

(65) Prior Publication Data

US 2023/0037020 A1 Feb. 2, 2023

Related U.S. Application Data

(63) Continuation of application No. 17/468,171, filed on Sep. 7, 2021, now Pat. No. 11,465,031.

(Continued)

(51) Int. Cl.

| | |
|---|---|
| ***A63B 71/06*** | (2006.01) |
| ***A63B 22/00*** | (2006.01) |
| ***A63B 22/02*** | (2006.01) |

(52) U.S. Cl.

CPC ..... *A63B 71/0622* (2013.01); *A63B 22/0023* (2013.01); *A63B 22/02* (2013.01);

(Continued)

(58) Field of Classification Search

CPC . A63B 71/0622; A63B 22/0023; A63B 22/02; A63B 2071/0638; A63B 2220/05;

(Continued)

(56) References Cited

U.S. PATENT DOCUMENTS

| | | | |
|---|---|---|---|
| 5,618,245 | A | 4/1997 | Trulaske et al. |
| 6,572,512 | B2 | 6/2003 | Anderson et al. |

(Continued)

OTHER PUBLICATIONS

Notice of Allowance, dated May 26, 2022, from corresponding U.S. Appl. No. 17/468,171.

(Continued)

*Primary Examiner* — Sundhara M Ganesan

(74) *Attorney, Agent, or Firm* — Thomas Horstemeyer, LLP

(57) ABSTRACT

In particular embodiments, a treadmill may comprise one or more lifting mechanisms configured to lift and lower a treadmill belt (e.g., adjust an angle of the treadmill belt relative to a support surface) by adjusting a height of the front and rear of the treadmill about a pivot point. In particular embodiments, the pivot point may be positioned somewhat centered along a length of the belt. In particular embodiments, a seesaw arrangement may provide a central pivot point, providing a moment arm to the motor while decreasing a moment arm caused by the load (e.g., a runner). In this way, an apparent load on a motor providing incline and decline to the running surface may be reduced.

20 Claims, 26 Drawing Sheets

Related U.S. Application Data

(60) Provisional application No. 63/182,349, filed on Apr. 30, 2021, provisional application No. 63/142,671, filed on Jan. 28, 2021, provisional application No. 63/114,251, filed on Nov. 16, 2020, provisional application No. 63/079,240, filed on Sep. 16, 2020.

(52) U.S. Cl.
CPC ... *A63B 2071/0638* (2013.01); *A63B 2220/05* (2013.01); *A63B 2220/10* (2013.01); *A63B 2220/30* (2013.01); *A63B 2220/806* (2013.01)

(58) Field of Classification Search
CPC ..... A63B 2220/10; A63B 2220/30; A63B 2220/806; A63B 22/0242; A63B 69/16; A63B 2022/0079; A63B 2024/009; A63B 2024/0093; A63B 2024/0096; A63B 2069/163; A63B 2069/168; A63B 2071/0683; A63B 24/0087; A63B 2071/0677; A63B 2220/16; A63B 2220/40; A63B 2220/78; A63B 2220/805; A63B 2225/20; A63B 2225/50
See application file for complete search history.

(56) References Cited

U.S. PATENT DOCUMENTS 6,585,624 B1 * 7/2003 Chen ..... A63B 22/0023 482/54
6,796,927 B2 9/2004 Toyama
7,101,317 B2 9/2006 Kuo
7,811,200 B2 10/2010 Chiang
8,021,270 B2 9/2011 D Eredita
8,029,415 B2 10/2011 Ashby et al.
8,251,874 B2 8/2012 Ashby et al.
8,845,493 B2 9/2014 Watterson et al.
9,067,097 B2 6/2015 Lane et al.
9,339,691 B2 5/2016 Brammer
9,849,333 B2 12/2017 Fung
9,927,312 B1 * 3/2018 Berme ..... A63B 22/025
10,391,361 B2 8/2019 Watterson
10,416,754 B2 9/2019 Smoot et al.
10,445,932 B2 10/2019 Chen et al.
10,449,435 B2 10/2019 Kim
10,576,328 B2 3/2020 Santra et al.
10,850,163 B2 12/2020 D'Alesio
10,915,166 B2 2/2021 Ishii et al.
10,955,909 B2 3/2021 Ishii et al.
10,974,094 B2 4/2021 Consiglio et al.
11,013,951 B2 5/2021 Rothschild
11,052,288 B1 7/2021 Berme et al.
11,173,342 B2 11/2021 Min et al.
11,605,500 B2 * 3/2023 Winter ..... H01F 3/12
2004/0180757 A1 * 9/2004 Levi ..... A63B 22/0023 482/54
2006/0063644 A1 3/2006 Yang
2006/0122035 A1 6/2006 Felix
2009/0023554 A1 1/2009 Shim
2009/0111670 A1 4/2009 Williams
2010/0035726 A1 2/2010 Fisher et al.
2010/0304931 A1 12/2010 Stumpf
2012/0071301 A1 * 3/2012 Kaylor ..... A63B 21/00058 482/57
2013/0123073 A1 * 5/2013 Olson ..... A63B 22/02 482/54
2013/0132910 A1 5/2013 Belmon
2016/0287930 A1 * 10/2016 Moser ..... A63B 24/0087
2017/0072254 A1 * 3/2017 Ryu ..... A63G 31/16
2017/0296865 A1 * 10/2017 Lagree ..... A63B 21/0407
2018/0036619 A1 * 2/2018 Kim ..... A63B 22/02
2018/0099205 A1 4/2018 Watterson
2018/0126248 A1 5/2018 Dion et al.
2018/0154207 A1 * 6/2018 Hochstrasser ..... A63B 22/025
2018/0161620 A1 * 6/2018 Rothschild ..... G06Q 30/0643
2018/0217662 A1 * 8/2018 Smoot ..... A63B 24/0021
2018/0345068 A1 * 12/2018 Beyer ..... A63B 22/0228
2019/0220088 A1 * 7/2019 Ishii ..... G06F 1/1694
2019/0220089 A1 7/2019 Kakizawa et al.
2019/0289285 A1 9/2019 Nashida et al.
2019/0307982 A1 10/2019 Brodsky
2020/0254300 A1 * 8/2020 Khilmanovich ... A63B 22/0023
2020/0254311 A1 8/2020 Watterson et al.
2021/0046353 A1 * 2/2021 Dalebout ..... A63B 22/0023
2021/0046373 A1 2/2021 Smith
2021/0069540 A1 * 3/2021 Yoo ..... A63B 22/0235
2021/0106875 A1 4/2021 Hansen et al.
2021/0106899 A1 4/2021 Willardson et al.
2021/0153470 A1 5/2021 Yoo et al.
2021/0220697 A1 7/2021 Chen
2021/0346752 A1 * 11/2021 Holmes ..... A63B 24/0075
2021/0346755 A1 * 11/2021 Epstein ..... A63B 22/0285

OTHER PUBLICATIONS

Office Action, dated Feb. 17, 2022, from corresponding U.S. Appl. No. 17/468,171.

* cited by examiner

AMBULATION SIMULATION SYSTEMS, TERRAIN SIMULATION SYSTEMS, TREADMILL SYSTEMS, AND RELATED SYSTEMS AND METHODS

CROSS REFERENCE TO RELATED APPLICATIONS

This application is a continuation of U.S. patent application Ser. No. 17/468,171, filed Sep. 7, 2021, which claims priority to U.S. Provisional Patent Application Ser. No. 63/079,240, filed Sep. 16, 2020, U.S. Provisional Patent Application Ser. No. 63/114,251, filed Nov. 16, 2020, U.S. Provisional Patent Application Ser. No. 63/142,671, filed Jan. 28, 2021, and U.S. Provisional Patent Application Ser. No. 63/182,349, filed Apr. 30, 2021, the disclosures of which are hereby incorporated herein by reference in their entirety.

BACKGROUND

Treadmills as well as stationary bikes are increasing in popularity as users seek exercise and other equipment that offer new features. Accordingly, there is a need for improved systems and methods that address these and other needs.

SUMMARY

A treadmill system, according to various embodiments, comprises: (1) a treadmill comprising one or more lifting mechanisms, the one or more lifting mechanisms being configured to adjust an orientation of a running surface of the treadmill about a pivot point; (1) a display screen; (3) one or more input devices; and (4) one or more computer processors. In any embodiment described herein, the one or more processors may be configured for: (1) displaying a virtual terrain on the display screen; (2) analyzing the virtual terrain to determine an angle of the virtual terrain; and (3) causing the one or more lifting mechanisms to adjust the orientation of the running surface based on the angle of the virtual terrain. In various embodiments, the one or more input devices comprise one or more imaging devices; and the one or more computer processors are further configured for: (1) generating, using the one or more imaging devices, an instantaneous skeletal map of a user of the treadmill; (2) analyzing the instantaneous skeletal map to identify a gesture performed by the user; (3) determining, based at least in part on the gesture performed by the user, a corresponding action; and (4) executing the corresponding action by causing at least one of: (A) modifying a position of a virtual representation of the user in the virtual terrain on the display screen; and (B) modifying at least one of the orientation of the running surface and a belt speed of the treadmill.

In particular embodiments, analyzing the virtual terrain to determine the angle of the virtual terrain comprises determining a slope of the virtual terrain at a location of a virtual camera within the virtual terrain in the direction that the virtual camera is facing within the virtual terrain, wherein the virtual camera defines a portion of the virtual terrain that the one or more processors are displaying on the display screen. In various embodiments, causing the one or more lifting mechanisms to adjust the orientation of the running surface based on the angle of the virtual terrain comprises causing the one or more lifting mechanisms to adjust the orientation of the running surface such that the running surface is at an angle that corresponds to the angle of the virtual terrain. In still other embodiments, the one or more processors are further configured for: (1) receiving, via the one or more input devices, a request to modify a first treadmill setting; and (2) responsive to the request, modifying the first treadmill setting. In various embodiments, the one or more processors are further configured for: moving the virtual camera within the virtual terrain based on one or more treadmill settings; and displaying the virtual terrain on the display screen based on a current position of the virtual camera within the virtual terrain.

In a particular embodiments, the pivot point is positioned substantially centrally along the running surface of the treadmill.

In any embodiment described herein, the one or more lifting mechanisms comprise: a first motor; a first member operatively connected to the first motor and a front portion of the treadmill via a first rotating connector; a second motor; and a second member operatively connected to the second motor and a rear portion of the treadmill via a second rotating connector. In particular embodiment, the one or more computer processors are configured to control each of the first motor and the second motor to adjust a length of the first connector and second connector to adjust the orientation of the running surface of the treadmill about the pivot point. In various embodiments, the first connector and the second connector each comprise at least one of a cable or a chain; and the first rotating connector and the second rotating connector each comprise at least one of a sprocket and a pulley.

In various embodiments, the pivot point is positioned adjacent a rear of the running surface of the treadmill.

In particular embodiments, the one or more lifting mechanisms comprise: one or more motors; at least one cable operatively connected to the one or more motors and the front portion of the treadmill via one or more pulleys. In particular embodiments, the one or more computer processors are configured to control each the one or more motors to adjust a length of the one or more cables to adjust the orientation of the running surface of the treadmill about the pivot point.

A method, according to various embodiments, comprises: displaying, by computing hardware, a virtual terrain on a display screen from a first point of view at a location; determining, by the computing hardware, an angle of the virtual terrain at the location based on the first point of view; and causing, by the computing hardware, one or more lifting mechanisms to adjust an incline level of a treadmill based on the angle of the virtual terrain at the location. In particular embodiments, causing the one or more lifting mechanisms to adjust the incline level of the treadmill based on the angle of the virtual terrain at the location comprises adjusting the incline level such that the treadmill is at an angle that corresponds to the angle of the virtual terrain.

In some embodiments, the method further comprises receiving, by the computing hardware via one or more input devices, a first request to modify a first treadmill setting for the treadmill; and responsive to the first request, causing, by the computing hardware, the treadmill to modify the first treadmill setting. In still other embodiments, the method further compress receiving, by the computing hardware via the one or more input devices, a second request to adjust a direction of the first point of view; and responsive to the second request, modifying, by the computing hardware, the first point of view to a second point of view based on the second request. In some embodiments, the one or more input devices comprise one or more imaging devices; the first request comprises a first gesture performed by a user of the treadmill; and the second request comprises a second gesture performed by the user of the treadmill.

In any embodiment described herein, the method further comprises continuously modifying, by the computing hardware, the location based on one or more treadmill settings. In various embodiments, the one or more treadmill settings comprise a belt speed of the treadmill. In some embodiments, the method comprises continuously causing, by the computing hardware, the one or more lifting mechanisms to adjust the incline level of the treadmill based on a substantially current angle of the virtual terrain at a substantially current angle of the virtual terrain at a substantially current location. In particular embodiments, continuously causing the one or more lifting mechanisms to adjust the incline level of the treadmill is further based on a current point of view displayed on the display screen.

BRIEF DESCRIPTION OF THE DRAWINGS

Various embodiments of a treadmill system (e.g., exercise device system) are described below. In the course of this description, reference will be made to the accompanying drawings, which are not necessarily drawn to scale, and wherein.

DETAILED DESCRIPTION

Various embodiments now will be described more fully hereinafter with reference to the accompanying drawings. It should be understood that the invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overview

Figure 26:
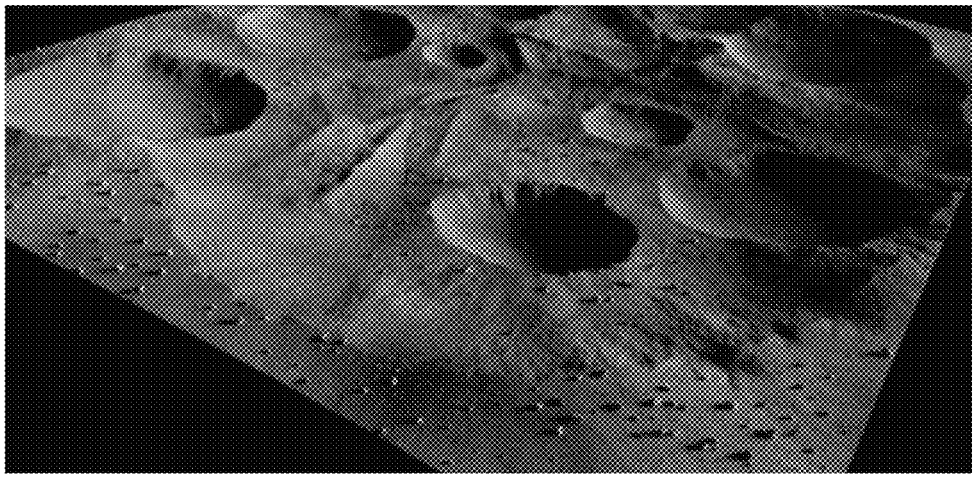
FIG. 26 depicts an exemplary surface of a virtual environment from an overhead view.
Figure 27:
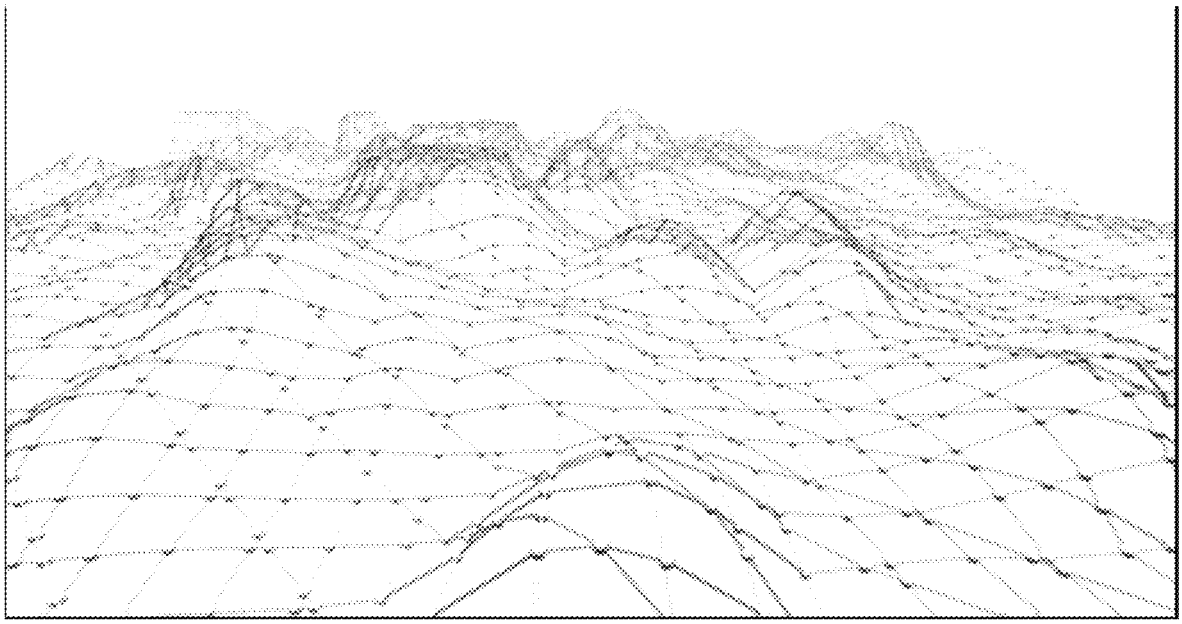
FIG. 27 depicts a wireframe view of the virtual environment shown in FIG. 26 from the point of view of a user's avatar traversing along the surface of the virtual environment.

In various embodiments, a treadmill system (i.e., an ambulation simulation system) may include one or more custom treadmill hardware devices and one or more accompanying pieces of software which may, for example, be configured to work in tandem to simulate one or more virtual terrains within a game on a physical treadmill. The system may, for example, be utilized in one or more sport training, entertainment, rehabilitation, and other contexts. In various embodiments, the system is configured to generate custom game-terrains for walking, hiking, running, etc. FIGS. 26 and 27 depict an exemplary virtual terrain through which a user may travel. In particular embodiments, the system is configured to enable a user to control a direction of a virtual avatar as the avatar traverses the virtual terrain (e.g., while the user is walking and/or running on the treadmill). The system may then be configured to manipulate the treadmill (i.e., an incline of the treadmill, speed of the treadmill, etc.) based on the terrain that the avatar is currently traversing. In particular embodiments, the system may utilize one or more imaging devices to generate a skeletal mapping of a user in order to identify particular poses and gestures performed by the user. In this way, the system may be configured provide hands free control to the user while the user is using the treadmill such that the user can move through the virtual environment (as it is displayed on a display screen) while providing input via any suitable system input described herein and physically walking/running through the environment by walking/running on the treadmill.

In various embodiments, the system is configured to utilize any suitable rapid incline/decline lifting system described herein (e.g., described above in the context of the bicycle riding system). In this way, the system is configured to simulate rolling hills, sudden drop-offs, and other features. In particular embodiments, in addition to gestures, the system may be configured to identify a position of a user within a width of the treadmill belt in order to provide input in order to navigate within the game. For example, the system may be configured to enable the user to sidestep rocks and other obstacles within the game by moving to one side of the belt or the other while running/walking. In still other embodiments, the system is configured to enable the user to walk along narrow portions of a virtual path (e.g., across a log) by remaining centrally positioned on the belt. As such, the system may be configured to provide a more realistic/immersive running/walking experience than a traditional treadmill that would not be capable of such rapid incline changes and would generally be operated at a consistent speed for the duration of an exercise. In particular embodiments, the treadmill may include a centralized pivot point (e.g., as opposed to a pivot adjacent a rear of the treadmill) to facilitate lifting and lowering of the front and/or rear of the treadmill to increase or decrease a level of incline of the treadmill. The system may further be configured to enable a treadmill to decline below a flat surface (e.g., to simulate downhill walking and/or running).

In still other embodiments, a bicycle riding system, according to various embodiments, is configured to simulate a substantially realistic bicycle riding experience on a substantially stationary platform. The system may, for example, include a bicycle riding device configured to support a bicycle while the bicycle riding device adjusts a position and orientation of the bicycle (e.g., the front of the bicycle, the rear of the bicycle, etc.). In particular embodiments, the system may be configured to manipulate one or more bicycle support mechanisms (e.g., rollers) via a combination of one or more motors and other components in order to adjust a position, angle, relative position, height, slope, slant, etc. of each bicycle support mechanism (e.g., for both the front and rear tires). In particular embodiments, the system is configured to manipulate a bicycle support surface based on terrain data. The system may, for example, be configured to adjust a simulated position and orientation of a supported bicycle based on terrain data that corresponds to a virtual terrain. The system may further manipulate the simulated bicycle position based on pedal speed, handlebar angle, lean of the rider, etc. In various embodiments, the system includes a virtual simulation in addition to a physical simulation, in which an avatar representing the rider traverses a terrain while the rider experiences changes in terrain on the bicycle riding device. Various concepts related to particular embodiments of a bicycle riding system are discussed more fully below.

In any other embodiment described herein, an exercise device system may be configured to perform any function described herein in the context of one or more other exercise devices. These may include, for example, Jacob's ladder, climbing wall, rowing apparatus, etc.

Exemplary Technical Platforms

As will be appreciated by one skilled in the relevant field, the present invention may be, for example, embodied as a computer system, a method, or a computer program product. Accordingly, various embodiments may take the form of an entirely hardware embodiment, an entirely software embodiment, or an embodiment combining software and hardware aspects. Furthermore, particular embodiments may take the form of a computer program product stored on a computer-readable storage medium having computer-readable instructions (e.g., software) embodied in the storage medium. Various embodiments may take the form of web-implemented computer software. Any suitable computer-readable storage medium may be utilized including, for example, hard disks, compact disks, DVDs, optical storage devices, and/or magnetic storage devices.

Various embodiments are described below with reference to block diagrams and flowchart illustrations of methods, apparatuses (e.g., systems), and computer program products. It should be understood that each block of the block diagrams and flowchart illustrations, and combinations of blocks in the block diagrams and flowchart illustrations, respectively, can be implemented by a computer executing computer program instructions. These computer program instructions may be loaded onto a general purpose computer, special purpose computer, or other programmable data processing apparatus to produce a machine, such that the instructions are executed on the computer or other programmable data processing apparatus to create means for implementing the functions specified in the flowchart block or blocks.

These computer program instructions may also be stored in a computer-readable memory that can direct a computer or other programmable data processing apparatus to function in a particular manner such that the instructions stored in the computer-readable memory produce an article of manufacture that is configured for implementing the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Accordingly, blocks of the block diagrams and flowchart illustrations support combinations of mechanisms for performing the specified functions, combinations of steps for performing the specified functions, and program instructions for performing the specified functions. It should also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and other hardware executing appropriate computer instructions.

Example System Architecture

Figure 1:
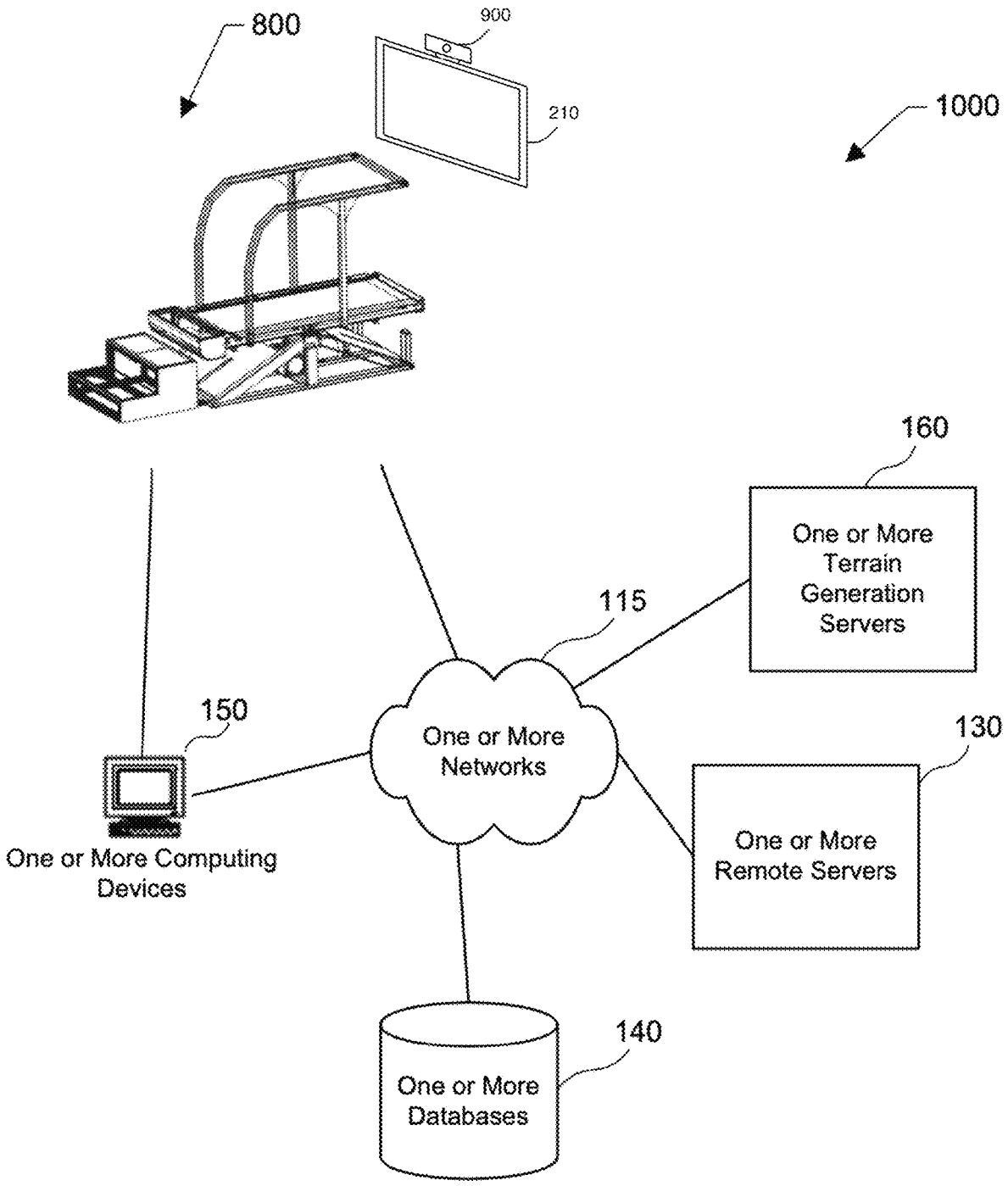
FIG. 1 depicts a treadmill system 1000 according to a particular embodiment.

FIG. 1 is a block diagram of a treadmill system 1000 according to a particular embodiment. In some embodiments, the treadmill system 1000 is configured to analyze terrain and sensor data and, in response, manipulate one more components of the treadmill system 1000 (e.g., one or more motors) to cause a treadmill 800 to modify a position/speed/incline/etc.

As may be understood from FIG. 1, the treadmill system 1000 includes one or more computer networks 115, a treadmill 800, one or more remote servers 130, one or more terrain generation servers 160, one or more computing devices (e.g., such as a desktop computer, laptop computer, tablet computer, smartphone, etc.) 150, and one or more databases 140. In particular embodiments, the one or more computer networks 115 facilitate communication between the one or more computing devices 150 and the one or more terrain generation servers 160.

The one or more computer networks 115 may include any of a variety of types of wired or wireless computer networks such as the Internet, a private intranet, a public switch telephone network (PSTN), or any other type of network. The communication link between the one or more computing devices 150 and the one or more terrain generation servers 160 may be, for example, implemented via a Local Area Network (LAN) or via the Internet.

Figure 2:
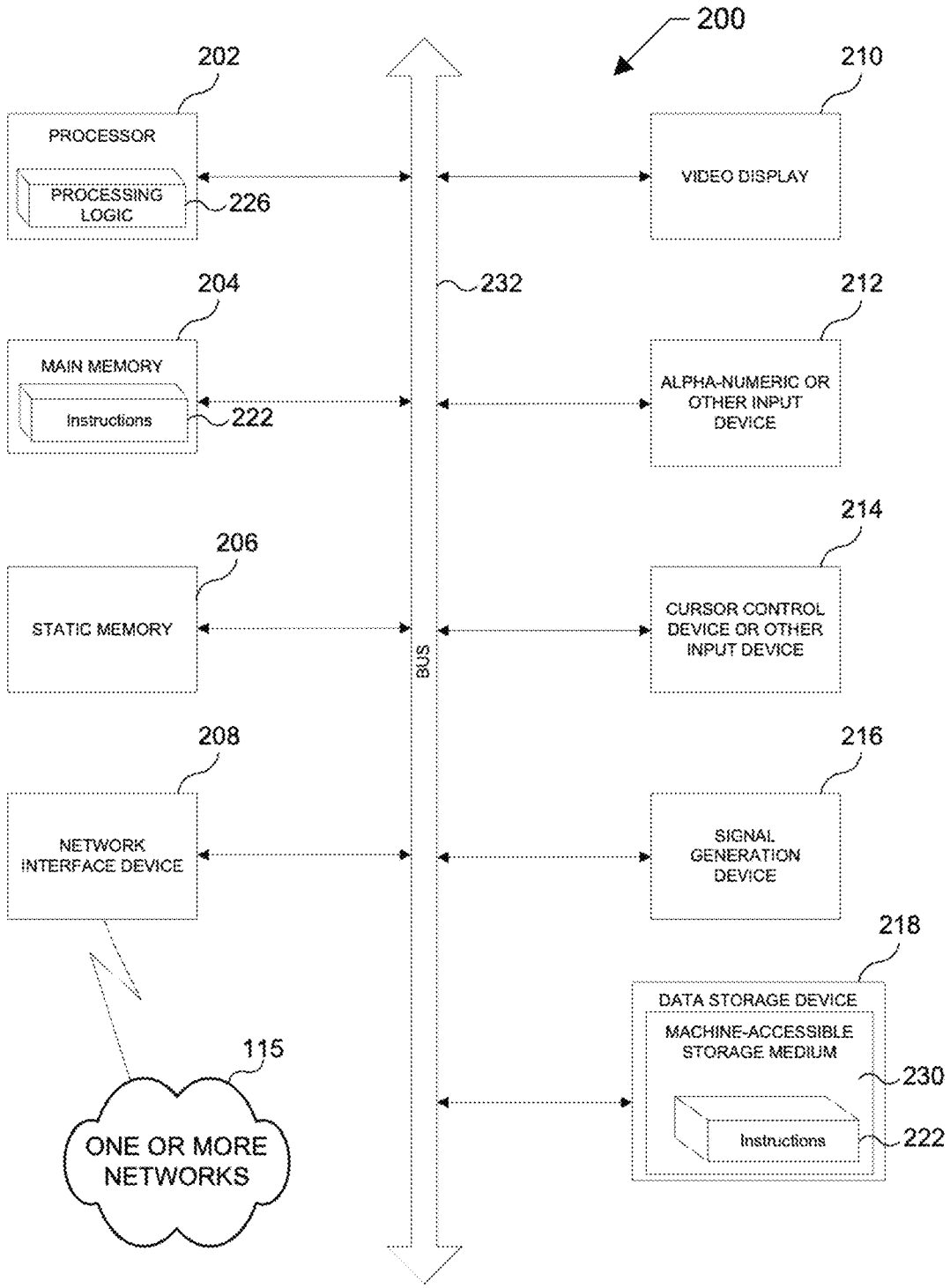
FIG. 2 is a schematic diagram of a computer, such as the One or More Computing Devices 150 or the One or More Terrain Generation Servers 160 of FIG. 1, that is suitable for use in various embodiments.

FIG. 2 illustrates a diagrammatic representation of a Computer Architecture 200 that can be used within the bicycle riding system 100, for example, as the One or More Computing Devices 150. In particular embodiments, the Computer 200 may be suitable for use as a computer within the context of the bicycle riding system 100 that is configured to: (1) generate one or more pieces of virtual terrain; (2) send one or more control signals to one or more components of the bicycle riding device 300; (3) etc.

In particular embodiments, the Computer 200 may be connected (e.g., networked) to other computers in a LAN, an intranet, an extranet, and/or the Internet. As noted above, the Computer 200 may operate in the capacity of a server or a client computer in a client-server network environment, or as a peer computer in a peer-to-peer (or distributed) network environment. The Computer 200 may be a desktop personal computer (PC), a tablet PC, a set-top box (STB), a Personal Digital Assistant (PDA), a cellular telephone, a web appliance, a server, a network router, a switch or bridge, or any other computer capable of executing a set of instructions (sequential or otherwise) that specify actions to be taken by that computer. Further, while only a single computer is illustrated, the term "computer" shall also be taken to include any collection of computers that individually or jointly execute a set (or multiple sets) of instructions to perform any one or more of the methodologies discussed herein.

An exemplary Computer 200 includes a Processing Device 202 (e.g., one or more computer processors), a Main Memory 204 (e.g., read-only memory (ROM), flash memory, dynamic random access memory (DRAM) such as synchronous DRAM (SDRAM) or Rambus DRAM (RDRAM), etc.), a Static Memory 206 (e.g., flash memory, static random access memory (SRAM), etc.), and a Data Storage Device 218, which communicate with each other via a Bus 232.

The Processing Device 202 represents one or more general-purpose processing devices such as a microprocessor, a central processing unit, or the like. More particularly, the Processing Device 202 may be a complex instruction set computing (CISC) microprocessor, reduced instruction set computing (RISC) microprocessor, very long instruction word (VLIW) microprocessor, Scaler Board, or processor implementing other instruction sets, or processors implementing a combination of instruction sets. The Processing Device 202 may also be one or more special-purpose processing devices such as an application specific integrated circuit (ASIC), a field programmable gate array (FPGA), a digital signal processor (DSP), network processor, or the like. The Processing Device 202 may be configured to execute Processing Logic 226 for performing various operations and steps discussed herein.

The Computer 200 may further include a Network Interface Device 208. The Computer 200 also may include a Video Display Unit 210 (e.g., a liquid crystal display (LCD), LED display, OLED display, plasma display, a projector, a cathode ray tube (CRT), any suitable display described herein, or any other suitable display), an alphanumeric or other input device 212 (e.g., a keyboard), a cursor control or other Input Device 214 (e.g., a mouse, stylus, pen, touch-sensitive input device, Touch Input Device 105, etc.), and a Signal Generation Device 216 (e.g., a speaker).

The Data Storage Device 218 may include a non-transitory Computer-accessible Storage Medium 230 (also known as a non-transitory computer-readable storage medium or a non-transitory computer-readable medium) on which is stored one or more sets of instructions (e.g., Software 222) embodying any one or more of the methodologies or functions described herein. The Software 222 may also reside, completely or at least partially, within the Main Memory 204 and/or within the Processing Device 202 during execution thereof by the Computer 200—the Main Memory 204 and the Processing Device 202 also constituting computer-accessible storage media. The Software 222 may further be transmitted or received over a Network 115 via a Network Interface Device 208.

While the Computer-accessible Storage Medium 230 is shown in an exemplary embodiment to be a single medium, the term "computer-accessible storage medium" should be understood to include a single medium or multiple media (e.g., a centralized or distributed database, and/or associated caches and servers) that store the one or more sets of instructions. The term "computer-accessible storage medium" should also be understood to include any medium that is capable of storing, encoding or carrying a set of instructions for execution by the computer and that cause the computer to perform any one or more of the methodologies of the present invention. The term "computer-accessible storage medium" should accordingly be understood to include, but not be limited to, solid-state memories, optical and magnetic media, etc.

More Detailed Discussion

As may be understood in light of this disclosure, a treadmill system 1000 may include a treadmill 800, which may, for example, include a display device 210 and one or more imaging devices 900 (e.g., and/or any suitable input device or combination of input devices). In particular embodiments, the treadmill 800 may include any suitable treadmill, which may, for example, comprise any suitable belt-driven simulated running surface.

Virtual Terrain Simulation Systems

In particular embodiments, any treadmill system described herein (e.g., as discussed herein) may be integrated into a virtual terrain simulation system. As may be understood in light of the systems described herein, a treadmill system may provide one or more system inputs and system outputs to the virtual terrain simulation system by, for example: (1) providing system input to the virtual terrain simulation system such as requests for changes in speed, direction, incline, etc.; and (2) provide one or more system outputs by, for example, modifying a belt speed, belt angle, etc. in response to one or more conditions within the virtual terrain simulation systems.

In particular embodiments, the virtual terrain simulation system may include a mixed reality system in which a user of the treadmill system may interact with a virtual environment by providing input to the system and experiencing physical feedback through manipulation of one or more treadmill mechanisms while the user is using the treadmill. In particular embodiments, the user may view the virtual terrain system while on the treadmill using a suitable display screen, virtual reality headset, etc. In various embodiments, the system may provide a more engaging, realistic user experience for a user of a treadmill (e.g., in contrast with a traditional exercise class). In particular embodiments, a virtual camera may travel through the virtual environment based on both: (1) user inputs (direction change); and (2) treadmill settings (e.g., such as speed) such that the system displays (e.g., on the display screen 210) a substantially first-person view as the virtual camera traverses the virtual terrain. In this way, a user of the treadmill may experience a realistic walking and/or running through the virtual terrain.

Figure 3:
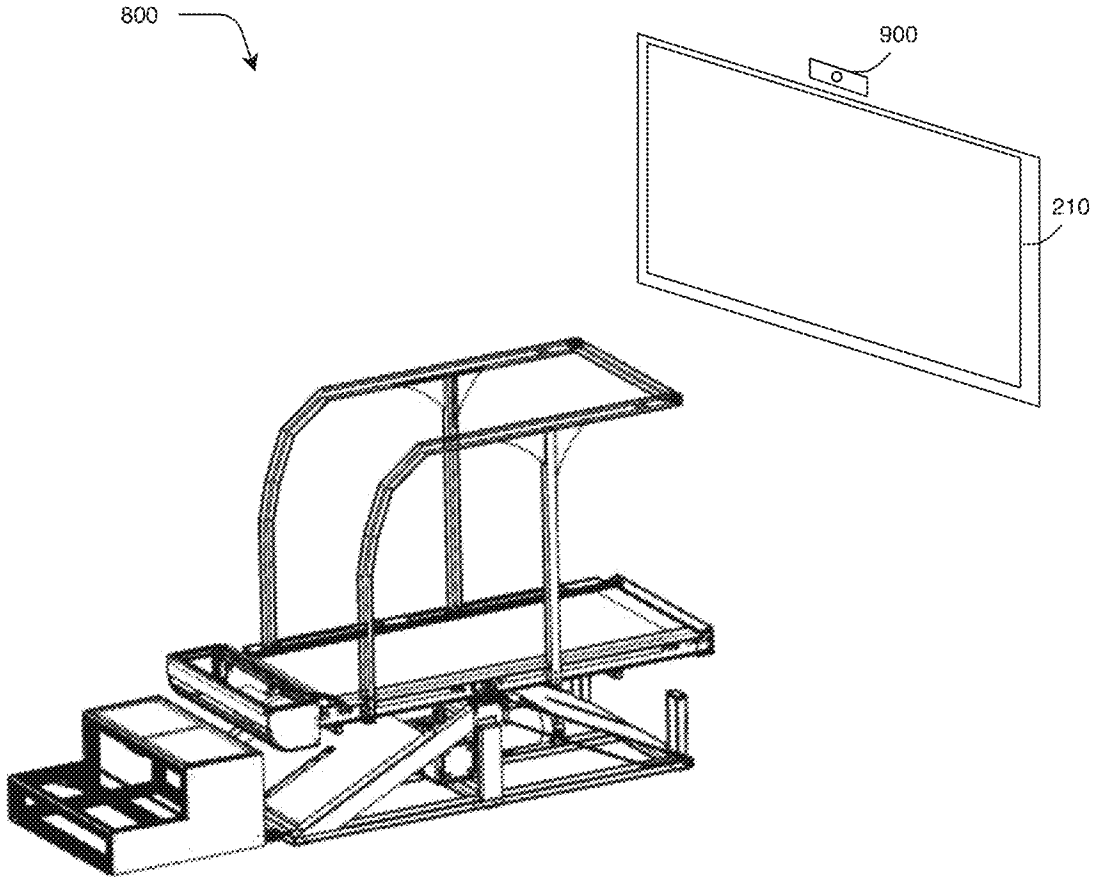
FIG. 3 depicts an exemplary treadmill (e.g., exercise device) according to particular embodiments.

FIG. 3 depicts a treadmill system 1000 according to various embodiments. In various embodiments, the treadmill 800 may include a tread that extends between one or more front and rear rollers. In such embodiments, the system may enable a runner to run along the tread surface. In particular embodiments, the system is configured to substantially automatically speed up and slowdown in response to identifying a change in running speed of the runner. The system may, for example, determine a change in distance of the runner/rider from the front of the device and speed up and/or slow down the belt in order to maintain the runner in a desired location in the belt (e.g., as the runner is running). In this way, the system may be configured to avoid having to require a user to manually modify a speed of the belt. The system may, for example, use software to keep the runner in the center of the belt, by identifying a slowdown in the user's gait (e.g., using one or more imaging devices, such as a Microsoft Kinect).

In particular embodiments, the treadmill may include one or more lifting mechanisms. In some embodiments, the one or more lifting mechanisms are configured to incline and/or decline a front or rear of the tread (e.g., and/or both the front and the rear) in order to modify an angle of the tread in order to simulate uphill and/or downhill walking/running. In particular embodiments, the system is configured to modify an incline and/or decline level of the treadmill based on one or more changes in terrain of a virtually generated terrain while the system is displaying the terrain on a display screen. For example, as a user's avatar encounters a virtual terrain that has a particular incline level, the system may be configured to automatically modify an incline of the treadmill in response (i.e., the system may be configured to automatically modify the incline based on the incline of the virtual terrain). In this way, the system may be configured to simulate, via physical manipulation of the tread, a running/walking/jogging experience that substantially mirrors the terrain as a user's avatar is traversing through the virtual terrain (e.g., and the system displays a first-person view of the movement through the terrain on the display screen).

Terrain Simulation System

Various functionality of the treadmill system 1000 may be implemented via various system modules. The system, when executing certain steps of such modules, may be configured to receive terrain and sensor data and, in response, send one or more control signals to one or more system components in order to manipulate a position, height, angle, or other orientation of an exercise device (e.g., treadmill). The system may perform the operations described in an order other than those in which they are presented in the various embodiments described herein. Various other embodiments of the system modules may perform steps in addition to those described or omit one or more of the described steps.

Figure 4:
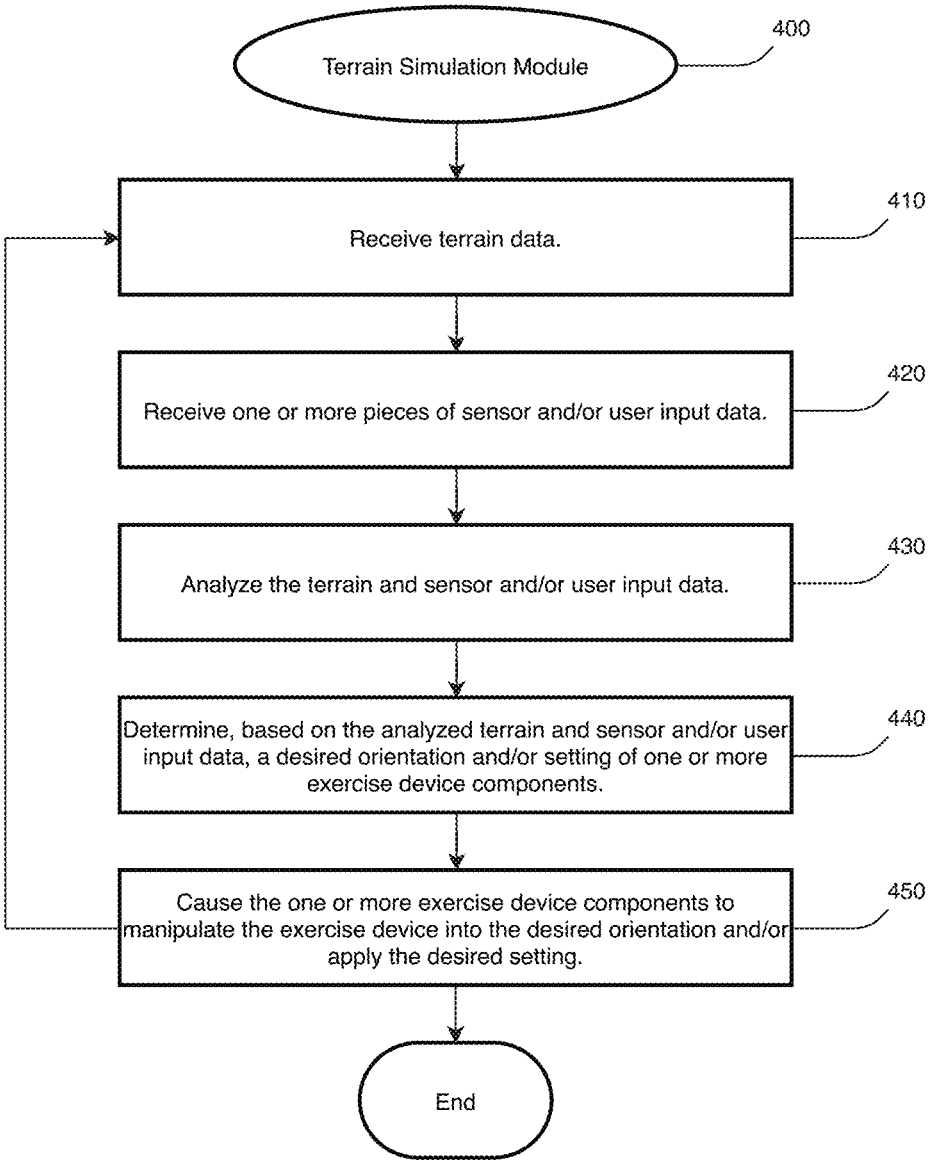
FIG. 4 depicts a terrain simulation module, which may, for example, receive data and control one or more operations of an exercise system (e.g., such as in the context of a treadmill system or bicycle riding system described herein)

FIG. 4 depicts an overview of various operations performed by the treadmill system 1000 when executing a terrain simulation module 400. In particular embodiments, the system is configured to control one or more operations of a treadmill 800 (e.g., or other exercise device). In particular embodiments, such as the embodiment shown in FIG. 4, the system begins at Step 410 by receiving terrain data. The system may, for example, receive the terrain data from one or more terrain generation systems that includes, for example, physical terrain data such as altitude, angle, incline, terrain type, etc. In various embodiments, the system is configured to receive terrain data that corresponds to one or more real-world locations. In still other embodiments, the system is configured to generate a custom terrain, which may, for example, be based on a desired difficulty level of a user. In particular embodiments, the system is configured to determine slope data for the virtual terrain (e.g., slope data corresponding to a current position and direction of an avatar positioned within the virtual terrain) using any suitable technique. This may include for example, determining the slope data based on a grid, raster, digital elevation model, and or other suitable technique. In still other embodiments, the terrain data may include position data of an avatar within the virtual terrain and the physical terrain data may be based on the position data.

The system continues, at Step 420, by receiving one or more pieces of sensor data and/or user input data. The one or more pieces of sensor data may, for example, include one or more pieces of sensor data related to a position of one or more components of a bicycle ridden by a rider on a bicycle riding device. For example, the system may use one or more encoders, accelerometers, gyroscopes, or other suitable sensors/devices to determine, for example: (1) running speed; (2) angle of the rider/runner relative to the exercise device; (3) handlebar angle (e.g., in embodiments in which the exercise device includes a bicycle); (4) pose of the rider/runner; (5) tilt of a bicycle relative to the bicycle riding device (e.g., in embodiments in which the exercise device comprises a bicycle); and/or (6) any other suitable sensor data.

In various embodiments, the one or more pieces of sensor data, may, for example, include image data (e.g., received from one or more imaging devices). In particular embodiments, the treadmill system is configured to enable a user to control one or more features of the system using one or more physical gestures (i.e., as opposed to providing physical input via one or more physical controls such as buttons, knobs, levers, etc.). For example, the system may be configured to identify particular user gestures and perform one or more actions in response to an identified gesture. In various embodiments, the system may be configured to associate particular actions with respective gestures and to perform the associated action in response to identifying the respective gesture. In some embodiments, the particular actions may include, for example: (1) speeding up the tread; (2) slowing down the tread; (3) changing an orientation of an avatar relative to a virtually generated terrain (e.g., as discussed more fully herein); (4) causing the avatar to turn to the left and/or right; (5) causing the avatar to avoid one or more obstacles on the virtual terrain; (6) etc.

In various embodiments, gestures that may be associated with particular actions may include, for example: (1) raising or lowering a user's hand; (2) placing one of the user's limbs in a particular orientation; (3) changing the user's position relative to a width of the tread (e.g., moving side to side); (4) jumping; (5) lifting a user's knee; (6) increasing or decreasing the user's running speed; and/or (7) any other suitable action which the system may be configured to identify.

In particular embodiments, as described herein, the treadmill system comprises one or more imaging devices 900 configured to generate a skeletal mapping (e.g., a substantially instantaneous skeletal map) of a user in order to identify one or more gestures performed by the user (e.g., based at least in part on a pose of the skeletal mapping). In various embodiments the one or more imaging devices may include any imaging device configured to identify key points in order to generate a skeletal mapping of a user (e.g., a Microsoft Kinect, Intel Realsense, iPhone, iPad, etc.). In other embodiments, the imaging device may be placed to track a particular user feature (e.g., foot, ankle, knee, leg, etc.). In some embodiments, the system is configured to determine user body positioning data based on one or more images (e.g., video images), one or more infrared images, etc. As may be understood from FIG. 5, the system may be configured to generate the skeletal mapping to determine a pose of the user.

Figure 5:
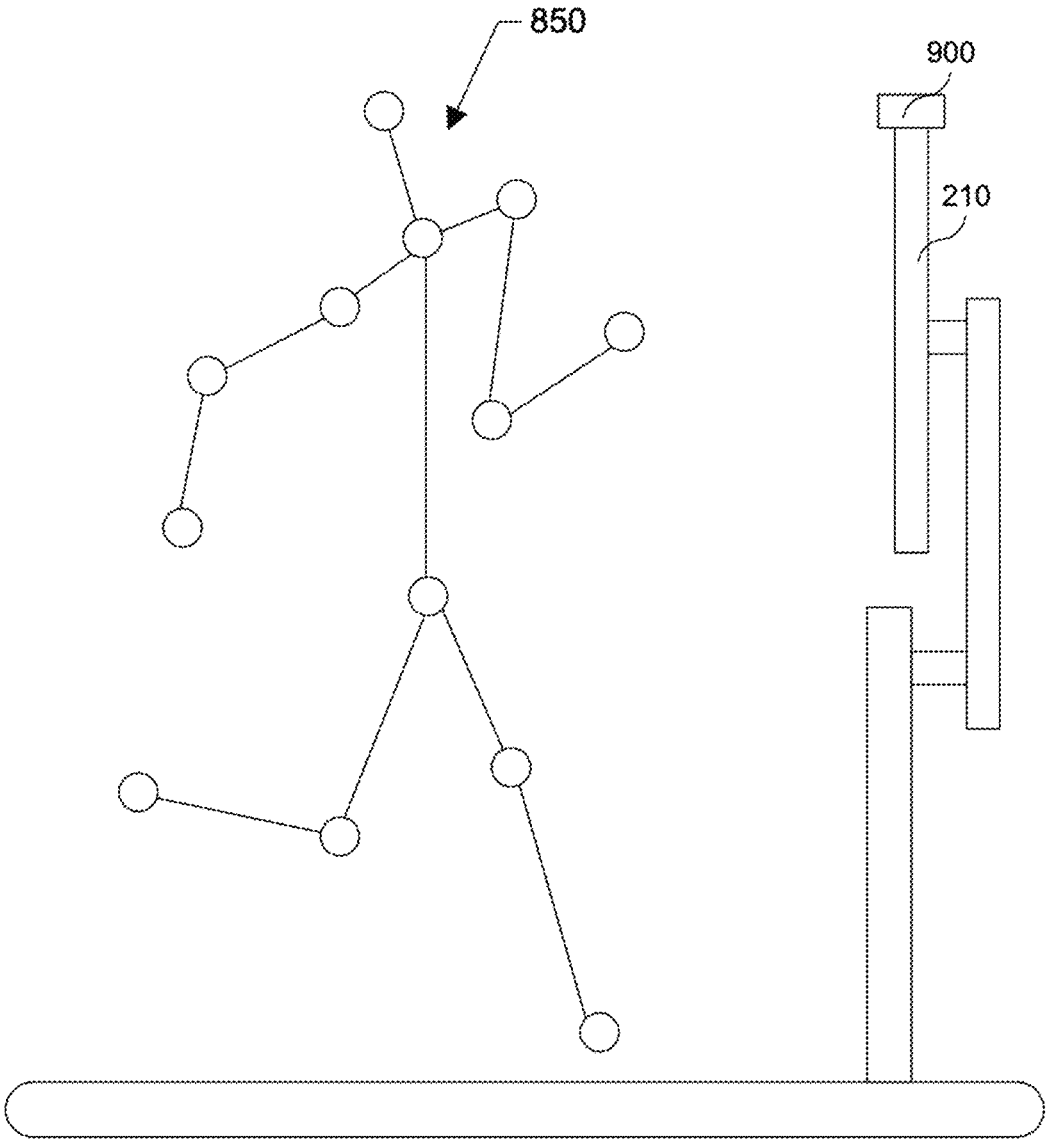
FIG. 5 depicts an exemplary skeletal mapping of a treadmill user, which may, for example, be generated by the system using one or more imaging devices, and used in the identification of one or more gestures made by the user.

FIG. 5 depicts an example skeletal mapping of a user that may be generated from the one or more imaging devices 900. In various embodiments, The system may be configured to identify a variety of joints, bones, or other portions of an individual's body such as, for example: (1) each of the user's hands; (2) each of the user's forearms; (3) each elbow; (4) each bicep; (5) each shoulder; (6) each hip; (7) each thigh; (8) each knee; (9) each foot; (10) the head; (11) the torso; (12) the top and bottom of the spine; (13) the waist; etc. In particular embodiments, the system is configured to identify and track additional points and features such as, for example: (1) individual bones; (2) joints of the fingers or toes; (3) individual features of the face, such as the nose and eyes; etc.

In various embodiments, the system is configured to enable the user to create gestures by performing particular movements. In some embodiments, a gesture may comprise a motion or pose by a user that the system is configured to capture as image data and parse for meaning. In various embodiments, particular gestures may include dynamic gestures, which may, for example, comprise a motion (e.g., lifting an arm at a particular speed, nodding a head, etc.). In still other embodiments, a gesture may include a static gesture, such as holding an arm up at a ninety-degree angle (e.g., to indicate a desire to stop the treadmill). In particular embodiments, a gesture may comprise more than one body part, such as clapping the hands together. In various embodiments, the system is configured to interpret any particular gesture as any particular user input (e.g., a first gesture may be associated with a first input type or action, a second gesture may be associated with a second input type or action, etc.). In particular embodiments, the system is configured to enable a user to assign particular action types or inputs to particular gestures.

In particular embodiments, the system is configured to interpret particular gestures as a system input. Gestures may be used for input in a general computing context. For example, as discussed above, particular gestures may correspond to particular movements of a user's avatar within a game (i.e., virtual terrain). Still other movements and/or gestures may correspond to particular settings or changes to settings for the treadmill or other exercise device (e.g., speed, elevation/incline, etc.).

In still other embodiments, the system may utilize one or more additional components in order to track one or more aspects of a user's body (i.e., movement, positioning, etc.) in order to determine one or more user actions (e.g., using one or more additional sensors or combination of sensors). The system may, for example, provide one or more tracking devices (e.g., comprising one or more accelerometers, gyroscopes, etc.) for placement on a particular portion of the user's body (i.e., one or more wrists, one or more ankles, around the user's chest, etc.). The one or more tracking devices may be configured to communicate with the system using any suitable wireless protocol (e.g., Bluetooth, zigbee, wireless LAN, NFC, etc.)

In various embodiments, each of the one or more motion trackers are configured to determine motion data for a respective portion of the user's body on which the respective device is placed and relays the motion data to the system. The system may be configured to receive the motion data from the trackers and, in response, cause the treadmill system to modify one or more settings based on the motion data (e.g., an incline level of the treadmill, a speed of the treadmill, etc.). In still other embodiments, the system is configured to receive the motion data from the trackers and, in response, provide input to a connected gaming environment in which an avatar representing the user is traversing a virtual terrain (e.g., by modifying a direction of the avatar within the virtual terrain, causing the avatar to take one or more actions within the virtual terrain, etc.).

In particular embodiments the system is configured to use motion data received from one or more tracking devices in combination with other data (e.g., imaging data, pressure data from one or more pressure sensors, etc.) in order to determine one or more responsive actions (e.g., one or more responsive actions to cause the treadmill or other device to take or to use as one or more inputs in a virtual game).

In some embodiments, the system may include one or more force sensors (e.g., one or more accelerometers, one or more pressure sensitive resistors, etc.) embedded in a deck of the treadmill. In this way, the system may be configured to triangulate a position of a user's foot upon impact of the treadmill's belt. The system may use impact data for each foot to determine, for example: (1) foot position; (2) stride length; (3) foot pressure (e.g., impact pressure); (4) etc. In various embodiments, the system may be configured to monitor pressure changes in each foot, for example, in order to monitor physical therapy progress, muscle imbalances, etc.

In some embodiments, the treadmill may include one or more pressure sensors on the belt, which may, for example, be configured to determine user gait information related to a position of a user's foot while walking/running. The system may, for example, be determined to identify a weight distribution of a user's foot on the tread. This may, for example, enable a user to trial a pair of footwear and otherwise determine which of one or more different types of footwear are most suitable based on the user's gait (e.g., based on different levels of arch support, different cushioning, etc.).

In various embodiments, the system is configured to merge data received from one or more cameras in addition to one or more pressure sensors and/or one or more tracking bands. For example, the system may be configured to determine a body angle based on data received from one or more sensors. As may be understood by one skilled in the art, as a user's running speed increases, the user may modify an angle of their body (e.g., such that their legs impart more thrust against the support surface at a more severe angle than while walking). In particular embodiments, the system is configured to determine stride length, in addition to 'hang time' (e.g., an amount of time in the air between foot falls). In various embodiments, the system may use hang time data to identify inefficiencies in a user's running motion (e.g., because too much time between steps may indicate a loss of efficiency).

In particular embodiments, the system is configured to track a respective position (e.g., and/or change in position) of each of the user's feet as the user is running/walking on the treadmill. The system may, for example, track the change in position and/or impact of each foot on the belt based on feedback from the one or more motion tracking devices and/or force sensors worn by the user. The system may then be configured to substantially automatically adjust a belt speed of the treadmill (e.g., on-the-fly) as the user increases or decreases their speed. For example, the system may be configured to monitor a change in position of each foot and cause the motor driving the belt to advance a distance based on the user's instantaneous stride length (i.e., of each leg).

In this way, the system may be configured to enable a user to adjust to any changes in terrain (i.e., incline, etc.) that the user may encounter while using the treadmill without having to provide any input to increase or decrease the belt speed (e.g., gesture input, button input, etc.). As the user's stride length increases, for example, the system may automatically increase the speed of the treadmill. In response to measuring a decrease in the user's stride length, the system may be configured to decrease the speed of the treadmill.

Returning to Step 430, the system is configured to analyze the terrain and sensor data. The system may, for example, be configured to analyze the data to determine a position of an avatar that represents the rider (e.g., runner) within the terrain (e.g., a substantially instantaneous position). The system may further analyze the terrain and sensor data to manipulate a location of an avatar (e.g., and/or virtual camera indicating what the avatar is viewing from a first person perspective) within the terrain. The system may then display a current image form the virtual camera on the display device.

At Step 440, the system is configured for, in response to analyzing the terrain and sensor data, determine a desired orientation of the exercise device based on the terrain and sensor data. The system may, for example, determine the desired orientation based on the physical terrain data and one or more sensor-determined aspects of the exercise device (e.g., or the user on the exercise device). For example, the system may determine a desired orientation of the exercise device (e.g., treadmill) based on an orientation that most closely simulates the terrain.

Figure 6:
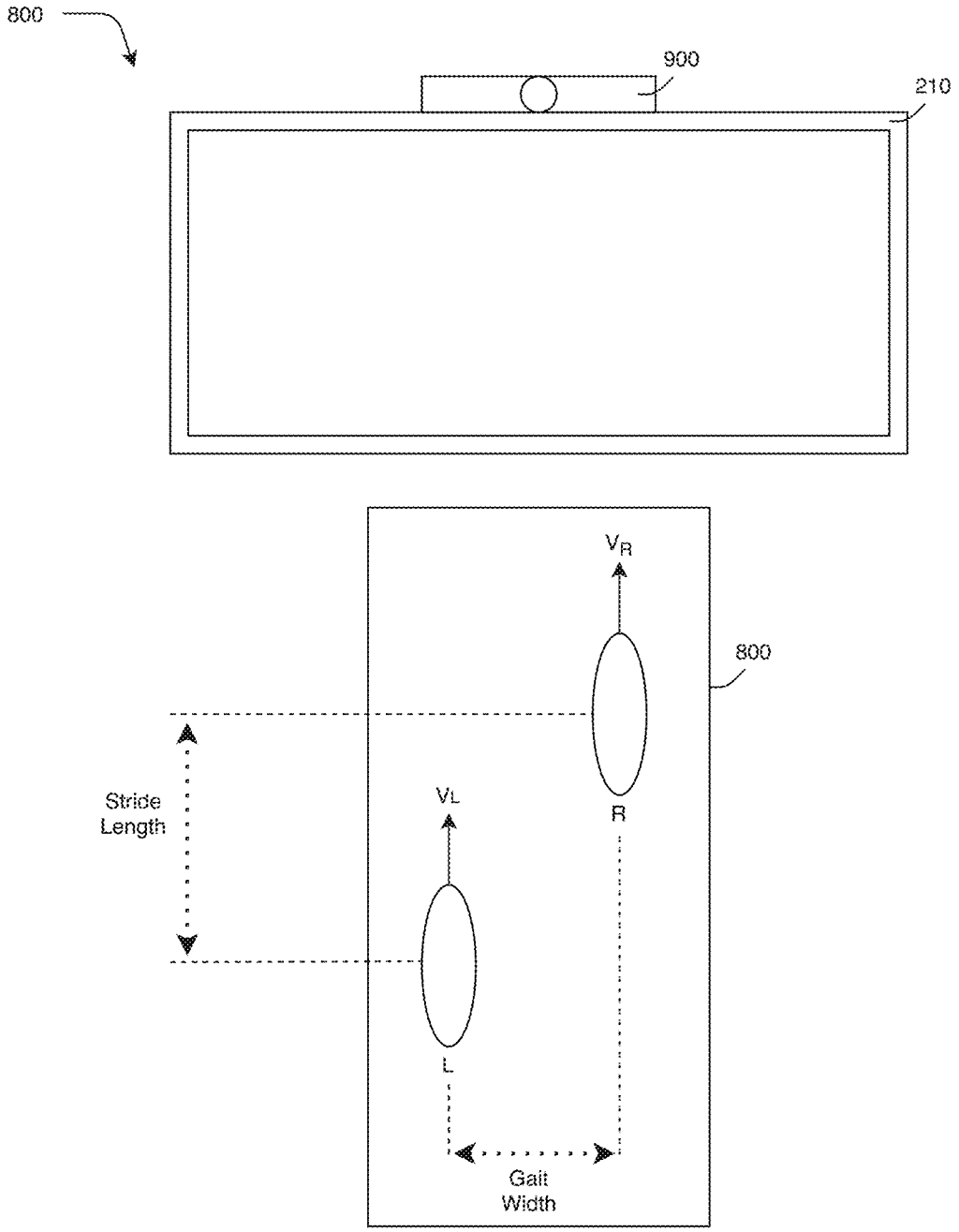
FIG. 6 depicts a diagrammatic representation of a user gait and stride length determination made by the system for use in various implementations of the system.

FIG. 6 depicts a diagram indicating the system tracking a user's stride length and gait. As may be understood from this disclosure, the system may be configured to determine, based on the skeletal mapping discussed herein: (1) a user's gait width; (2) a users' stride length (e.g., based on the distance between the landing of the user's feet and a distance of belt travel between footsteps; (3) a velocity of each respective foot, etc.).

In particular embodiments, as part of the analysis, the system is configured to record information about a user's gait characteristics, cadence, etc. in order to identify changes over time. For example, a user rehabilitating a leg injury may initially walk with a limp. The system may be configured to identify, based on the user's skeletal mapping, one or more characteristics of the user's limp such as: (1) the user favoring one particular leg over another; (2) the user leaning to one side; (3) one or more limits to the user's speed or ability to navigate certain levels of incline, etc. In various embodiments, the system may be able to track improvements to the user's gait over time in order to identify completion of a user's rehabilitation from an injury that caused the limp.

In particular embodiments, the system is configured to track a respective position of each of the user's feet as the user is running/walking on the treadmill. The system may then be configured to substantially automatically adjust a belt speed of the treadmill (e.g., on-the-fly) as the user increases or decreases their speed. For example, the system may be configured to monitor a change in position of each foot and cause the motor driving the belt to advance a distance based on the user's instantaneous stride length (i.e., of each leg). In this way, the system may be configured to enable a user to adjust to any changes in terrain (i.e., incline, etc.) that the user may encounter while using the treadmill without having to provide any input to increase or decrease the belt speed (e.g., gesture input, button input, etc.). As the user's stride length increases, for example, the system may automatically increase the speed of the treadmill. In response to measuring a decrease in the user's stride length (e.g., at a higher incline level), the system may be configured to decrease the speed of the treadmill.

In particular embodiments, the instantaneous speed adjustments may provide the user with more control over the experience, without having to provide any system input. The system may, for example, be configured to determine a real-time movement speed based in response to completion of a first step as the user drives off of a particular foot. The system may, for example, identify a new forward motion based on a lifting of a knee and/or foot, which may, for example, signal a new forward step by the user. In some embodiments, the system is configured to track user-specific characteristics in order to predict and/or identify a single stride length (e.g., knee position, hand position, arm pumping speed, etc.). In some embodiments, the system may similarly identify other actions by the user such as reversing (i.e., walking/running backwards), crouching, exaggerated longer strides to avoid obstacles, bunny hops to clear certain obstacles, etc.

In still other embodiments, the system is configured to automatically adjust a belt speed in response to a change in incline caused in response to position change within a virtual terrain. For example, the system may automatically reduce a belt speed as the incline of the treadmill increases. In still other embodiments, the system may comprise one or more mechanical breaks (e.g., electromagnetic breaks) configured to prevent slipping of the belt during incline and/or decline. For example, one or more rotors and/or motors may include one or more suitable breaking mechanisms.

In some embodiments, the treadmill may include one or more pressure sensors on the belt, which may, for example, be configured to determine user gait information related to a position of a user's foot while walking/running. The system may, for example, be determined to identify a weight distribution of a user's foot on the tread. This may, for example, enable a user to trial a pair of footwear and otherwise determine which of one or more different types of footwear are most suitable based on the user's gait (e.g., based on different levels of arch support, different cushioning, etc.).

Next, at Step 450, the system is configured to send one or more control systems to one or more exercise device components (e.g., treadmill components) based on the determined orientation. The system may, for example, activate one or more motors to adjust a belt speed of the treadmill. In still other embodiments, the system is configured to modify a position of a rider's avatar within a displayed version of the terrain based on the runner's inputs, lean, etc. The system may be further configured to cause the runner's avatar to traverse the terrain based on the sensor data (e.g., by turning, etc.) which may, in turn, adjust the terrain based on where the runner travels within the terrain. In this way, the system may be configured to enable the runner to 'freely' move within the terrain, while the treadmill (e.g., exercise device) adjusts the simulated terrain that the runner experiences based on the runner's position and orientation within the terrain, as well as the turning, leaning, etc. that the runner performs (e.g., and is determined by the sensor data or user input data). In other embodiments, the system may automatically activate a lifting mechanism configured to adjust an incline of the exercise device (e.g., the treadmill) to substantially match (e.g., correspond to) a level of incline based on a current position of a user's avatar within a virtual terrain.

Figure 7:
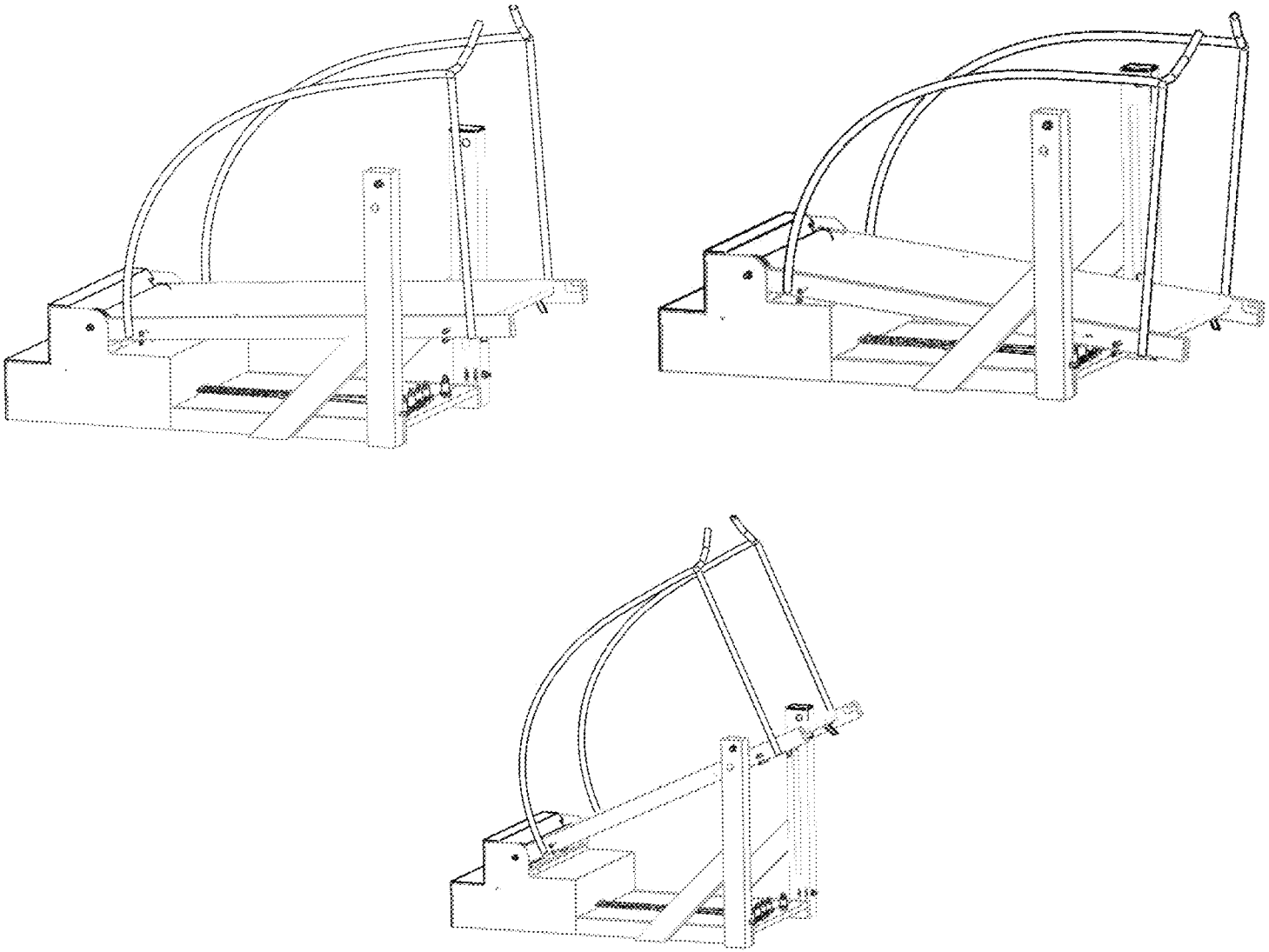
FIG. 7 depicts a treadmill according to particular embodiments in varying levels of elevation, which may, for example, result from: (1) one or more user gestures; (2) one or more changes in terrain, etc.

In particular embodiments, the treadmill may include one or more lifting mechanisms. In some embodiments, the one or more lifting mechanisms are configured to incline and/or decline a front or rear of the tread (e.g., and/or both the front and the rear) in order to modify an angle of the tread in order to simulate uphill and/or downhill walking/running. In certain embodiments, such as those shown in FIG. 7, the treadmill is configured to pivot about a point positioned adjacent a rear of the treadmill (e.g., by adjusting and/or lifting or lowering a front portion of the treadmill using any suitable lifting mechanism). In particular embodiments, the system is configured to modify an incline and/or decline level of the treadmill based on one or more changes in terrain of a virtually generated terrain while the system is displaying the terrain on a display screen. The system may, for example, activate the lifting mechanism to adjust an incline of the treadmill's running surface (e.g., upward or downward).

Exercise Devices According to Various Embodiments

Treadmill

In particular embodiments, a treadmill may comprise one or more lifting mechanisms configured to lift and lower a treadmill belt (e.g., adjust an angle of the treadmill belt relative to a support surface) by adjusting a height of the front and rear of the treadmill about a pivot point. In particular embodiments, the pivot point may be positioned in any suitable location between the front and rear of the treadmill (e.g., positioned somewhat centered along a length of the belt). In the embodiment shown in these figures, the treadmill includes a safety handrail and bar in front of and to either side of the runner. In the embodiment shown in this figure, the treadmill does not include a console with input controls. As discussed more fully herein, the system may employ gesture control through one or more imaging devices. In this way, the system may provide a safer experience by not requiring a user to look down in order to press a button to control a speed or incline of the treadmill. In this way, the user may continue looking ahead to make such setting adjustments, which can avoid unsafe situations resulting from a user looking down or struggling to find a desired button to press (e.g., which is particularly unsafe at an incline or when running at higher speeds).

Figure 8:
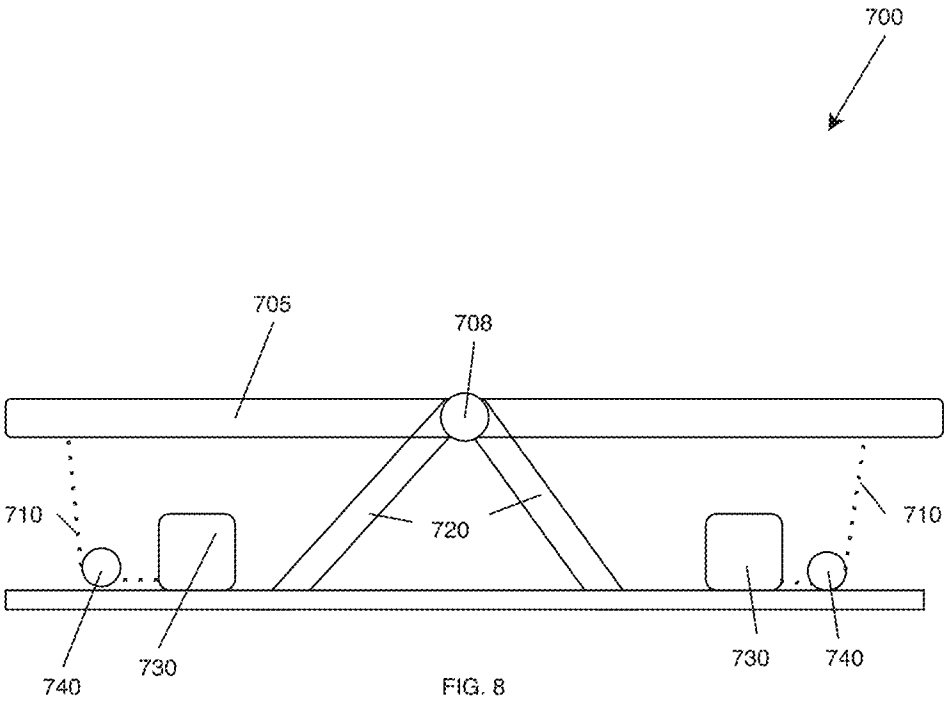
FIG. 8 depicts a treadmill according to other embodiments in which a pivot point enabling an incline and/or decline of the treadmill is positioned in a more central location.
Figure 9:
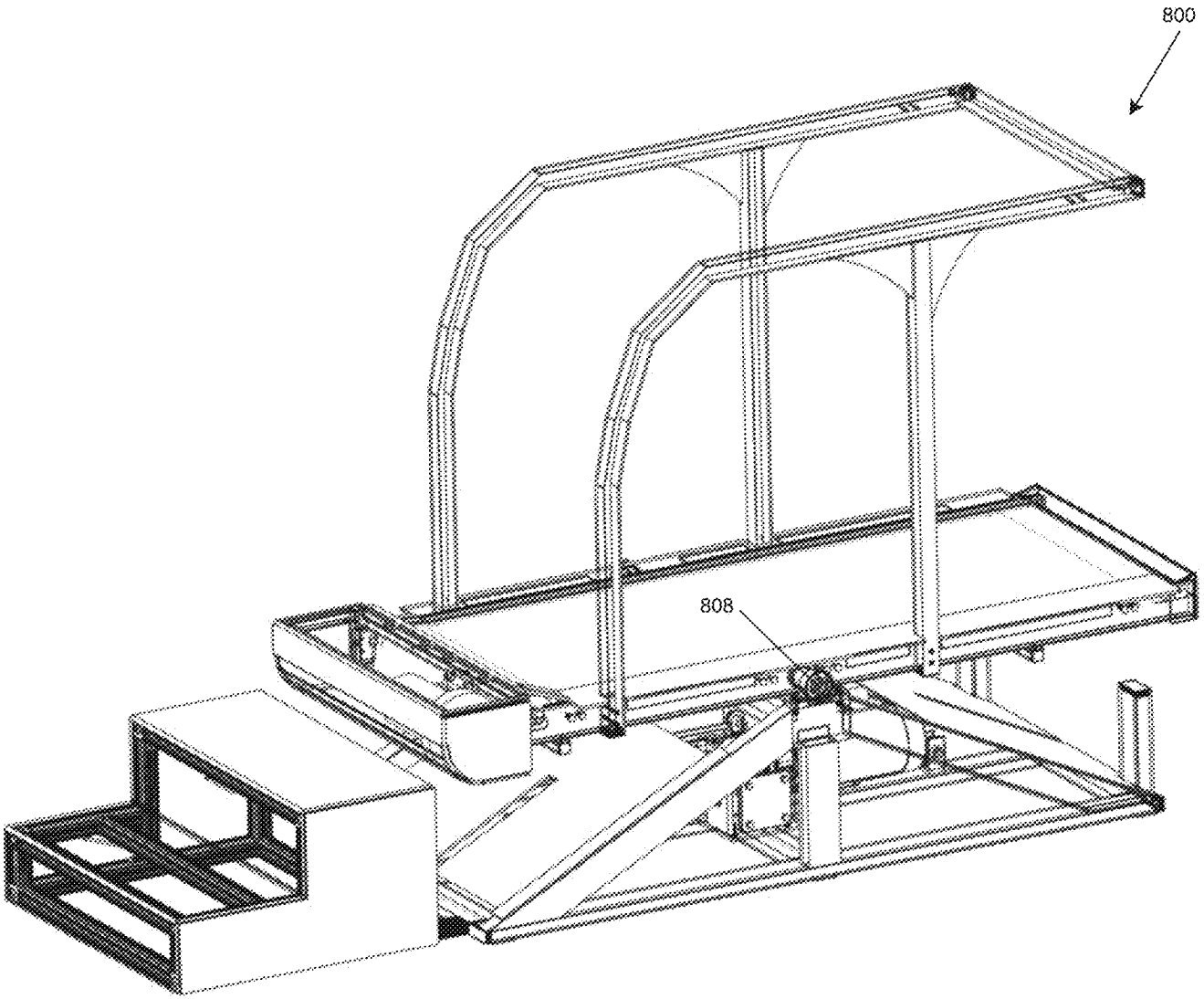
FIGS. 9-13 depict additional embodiments of a treadmill having a central pivot point at varying levels of incline.
Figure 10:
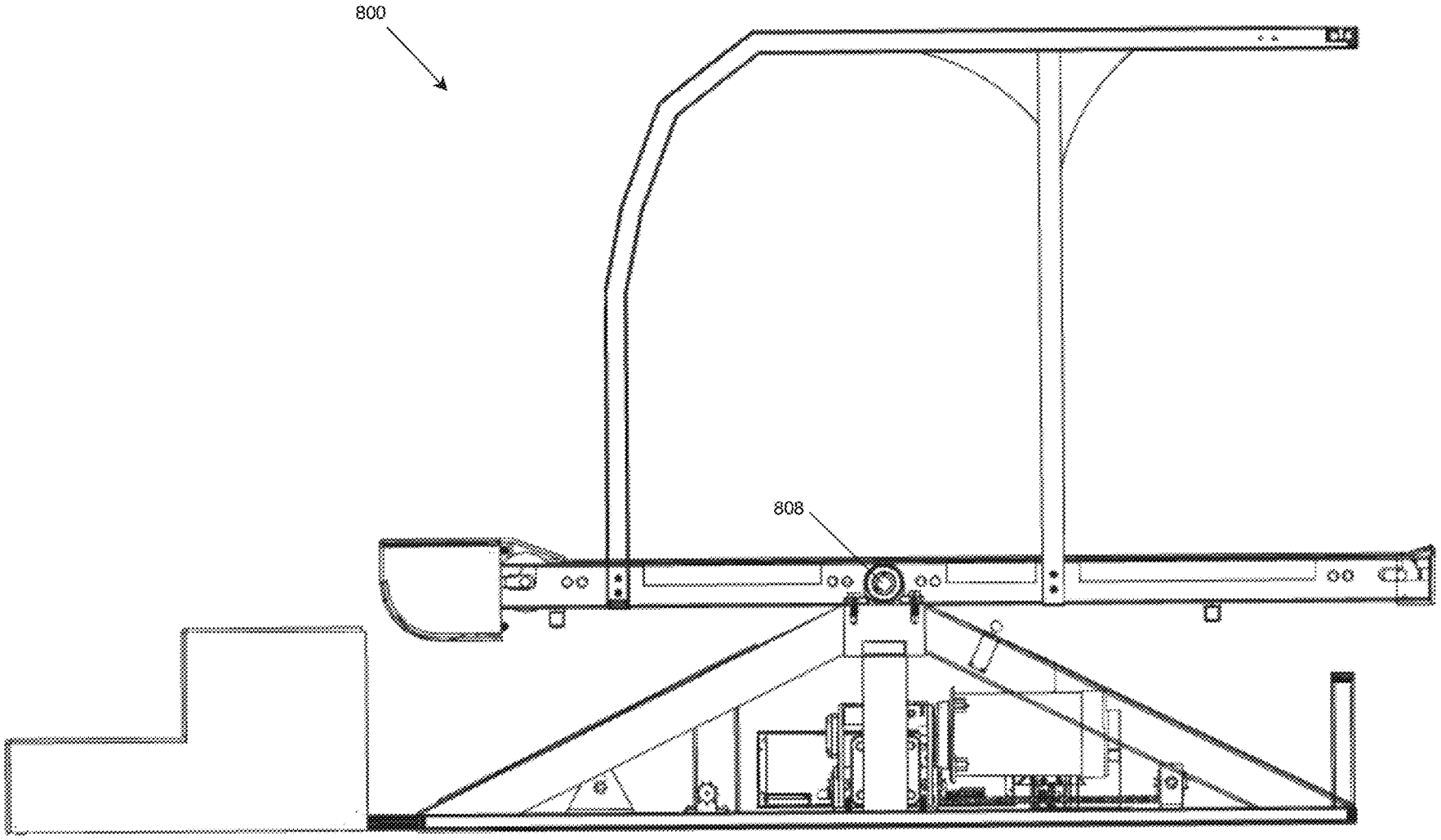
Figure 12:
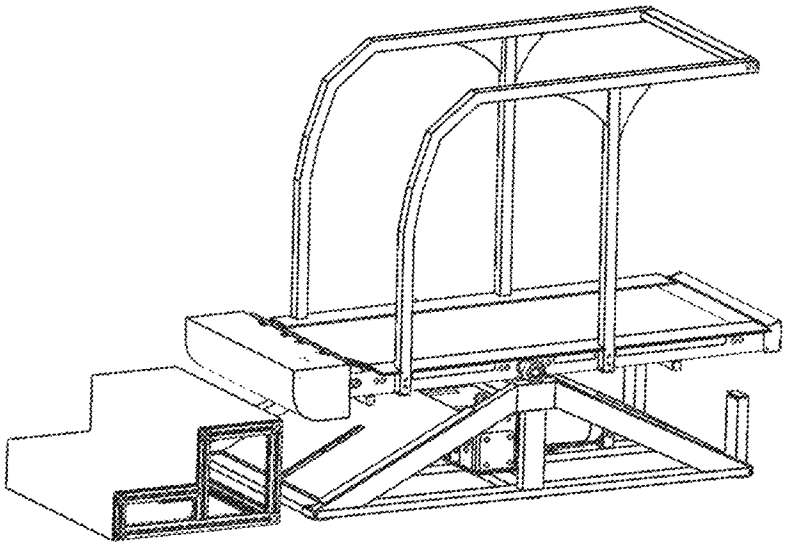
Figure 11:
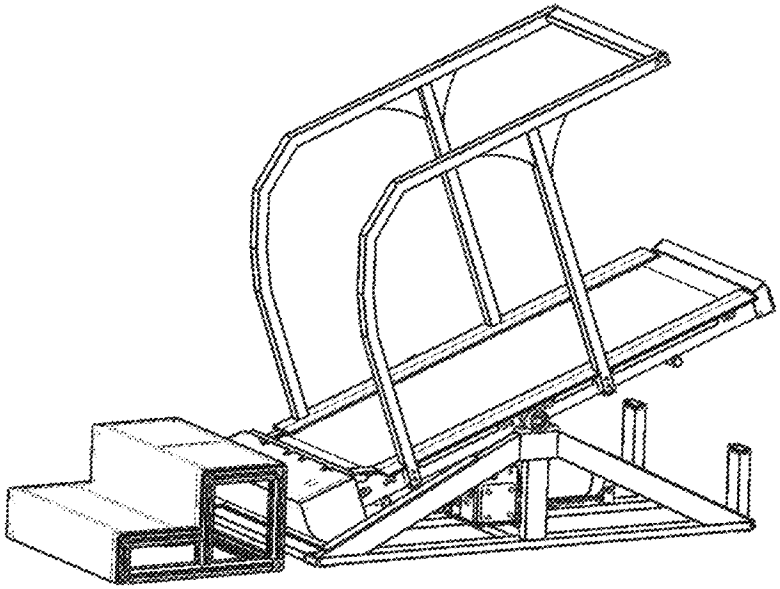
Figure 13:
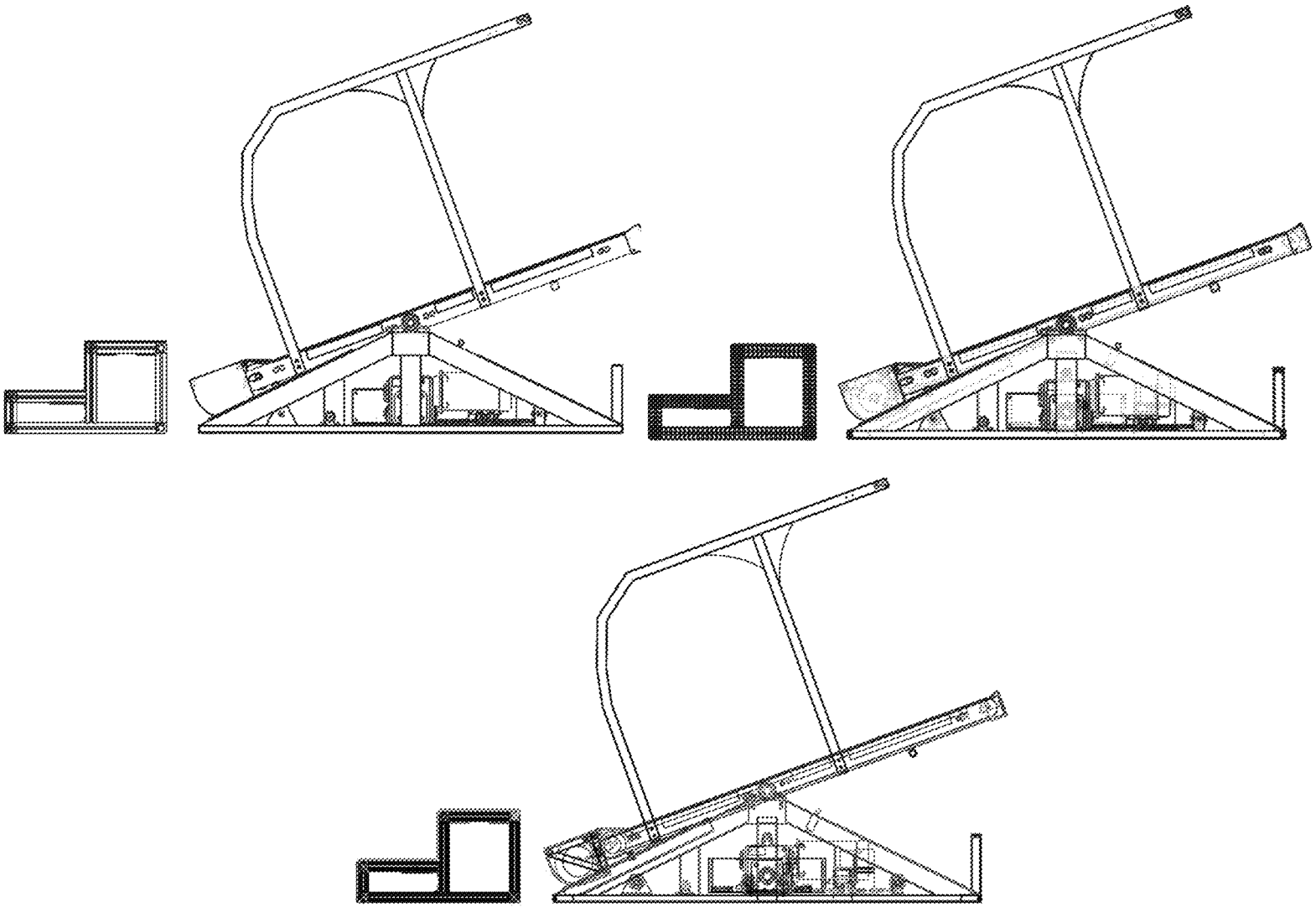

FIG. 8 depicts an exemplary embodiment of a treadmill in a "see-saw" design in which a pivot point for inclining and/or declining the treadmill is somewhat centrally positioned (e.g., centrally positioned) between a front and rear of the treadmill. As may be understood from this disclosure, although the "see-saw" treadmill will generally be described as having a central pivot point, it should be understood that various other embodiments may include a pivot point at any other suitable location between a front and rear of the treadmill (e.g., positioned approximately ¼ from the front end, ⅓ from the front end, $2/3^{rd}$ from the front end, $3/4^{th}$ from the front end, etc.).

In particular embodiments, a seesaw arrangement may provide a central pivot point, providing a moment arm to the motor while decreasing a moment arm caused by the load (e.g., the runner). In this way, an apparent load on a motor providing incline and decline to the running surface may be reduced by the system.

As shown in FIG. 8, a treadmill may include, for example, a belt 705 (e.g., running surface), one or more supports 720, one or more pulleys 740 (e.g., one or more sprockets), one or more motors 730, and one or more chains/cables. In particular embodiments, a respective motor 730 (and/or gearbox) may be configured to adjust a length of cable 710 (e.g., chain, link, rigid or semi-rigid connector, etc.) that attaches to a front or rear portion of the treadmill (e.g., a support structure for the belt 705) via a suitable pulley 740. In a particular embodiment, the treadmill includes at least one worm gearbox or other gearbox configured to provide holding torque to the cable (e.g., or other connector). In such embodiments, the gearbox may be configured to provide a holding torque to the cable in the instance of a power loss to one or more motors (e.g., which may enable the system to maintain a particular incline level in the case of power loss, thereby avoiding an unsafe condition for a user stemming from an unpredictable rapid incline or decline). In still other embodiments, a worm gear or other gearbox may be configured to provide holding torque the enables the system to operate more efficiently, as a motor may only draw current to drive the motion of an angle change for the treadmill running surface. In such embodiments, the system does not require power to the motor to maintain the treadmill at a particular incline level. In various other embodiments, the system may include any other suitable geared and/or braking system capable of holding a cable or other connection mechanism while the motor is off or has lost power. In particular embodiments, one or more controllers may be configured to control each of the one or more motors 730 to cooperate to adjust a length of the respective cables to adjust an incline/decline of the belt.

In various embodiments the cable may further include a chain tensioner or other mechanism for integrating the cable with one or more lengths of chain. In particular embodiments, each of the one or more motors are configured to release and/or pull the cable as necessary to enable the respective cable portions to hold the belt at a desired angle with sufficient force to support a runner on the surface of the belt 705 while the belt is running and maintained at the desired angle.

In particular embodiments, the see-saw arrangement described herein may provide a faster change in angle for the belt (e.g., faster than traditional systems which rely on one or more linear actuators to lift a front portion of the treadmill). In particular embodiments, the treadmill system comprises a system of one or more cables, chains, combination of cables and chains, or other suitable mechanism configured to cooperate to cause an incline and/or decline of a running platform (e.g., belt).

In various embodiments, the position of the pivot point 708 may reduce a load on the one or more motors while the belt 705 is in an incline or decline position. In a particular embodiment, the pivot point 708 may be positioned at least about $2/3^{rd}$ of the length of the belt from a front end of the treadmill.

In particular embodiments, a position of the pivot point and the load of the runner are configured to minimize a load on one or more motors that are causing the running platform to maintain a particular position (e.g., angle relative to the support surface). In particular embodiments, a position of the pivot point may be adjusted to modify a motor load and an effect on a lever arm created by a runner's position with respect to the pivot point. The system may, for example, be configured to utilize different pivot point positions for different applications (e.g., treadmill, rowing machine, etc.). In still other embodiments, the pivot point (e.g., position of the pivot point) is adjustable.

In particular embodiments, the treadmill system is designed such that a runner using the treadmill would have his or her weight substantially centered above the pivot point while running. In a particular embodiment, a drive motor for the belt may be configured to transfer rotation (e.g., via one or more belts) to a shaft at the pivot point, which may then be configured to transfer rotation to either the front roller or a back roller to drive a rotation of the running surface belt (e.g., treadmill surface). FIG. 8 depicts an embodiment in which a drive belt from a drive motor transfers rotational energy to a pivot shaft, which in turn, transfers energy to a rear roller which drives the running belt. The drive belt design described immediately above (e.g., with the drive belt initially driving rotation of a pivot shaft) may, for example, reduce a strain of driving a rear or front roller directly via a stationary motor, as a lifting or lowering of the front or rear of treadmill may exert additional tension on a drive belt in such embodiments. In still other embodiments, one or more motors may be mounted to the bed itself such that the one or more motors provide a direct drive to the belt. Such embodiments may, for example, limit a number of rotating elements and transmission belts and act as a counterweight to improve the efficiency of the lifting mechanism.

FIGS. 9-13 depict a treadmill with a centralized pivot at varying levels of incline/decline.

Figure 14:
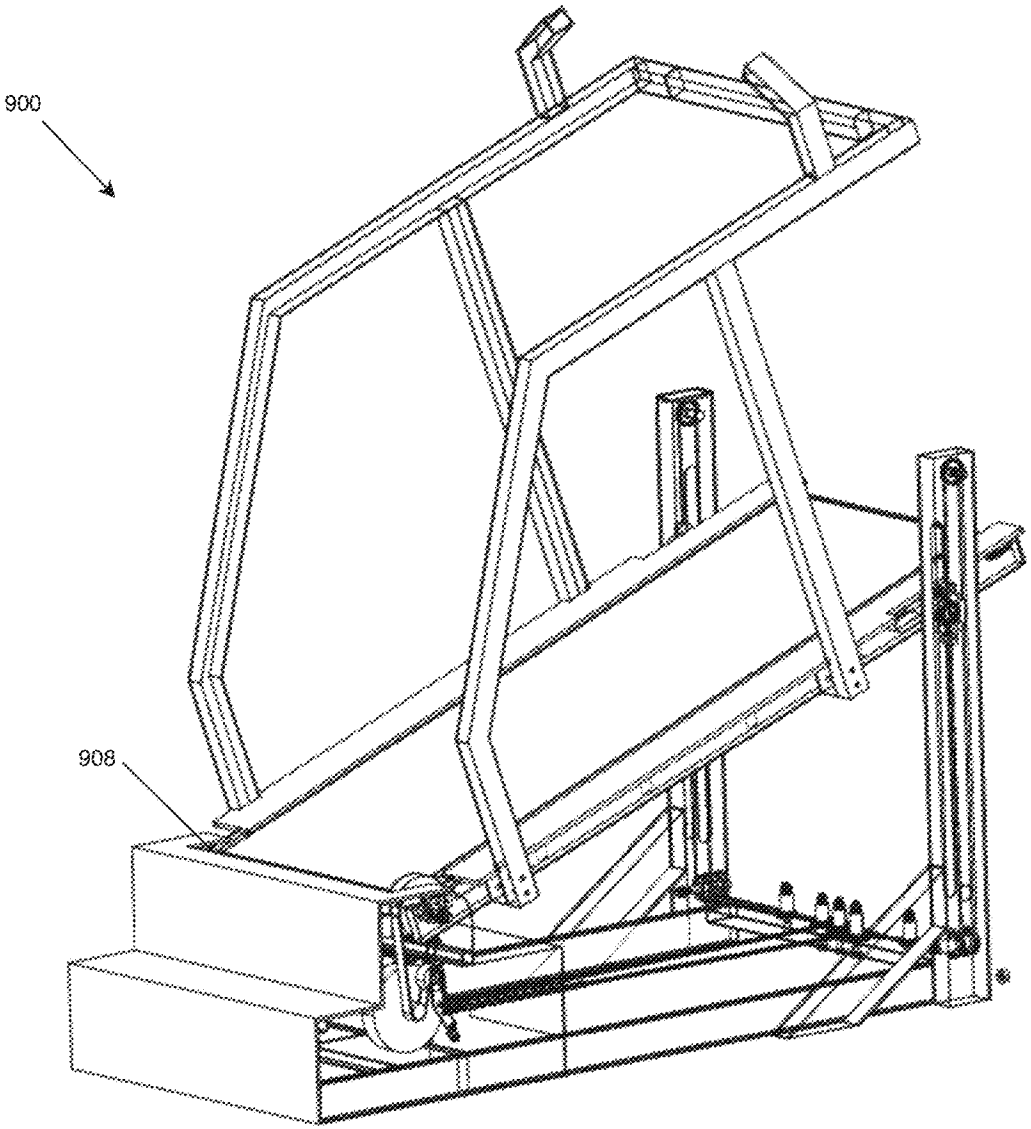
FIGS. 14-15 depict a treadmill according to yet another embodiment (e.g., with a rear pivot point)
Figure 15:
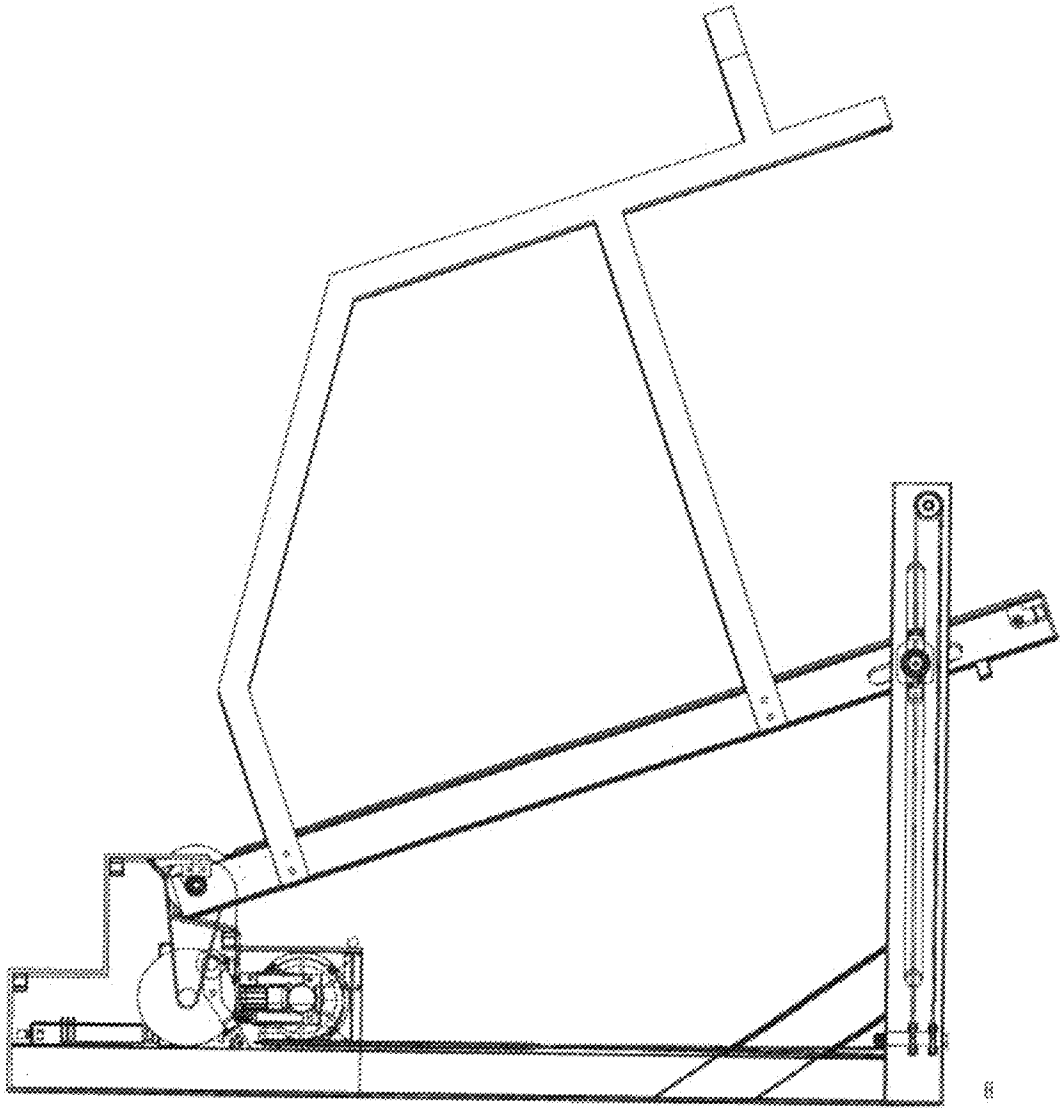
Figure 16:
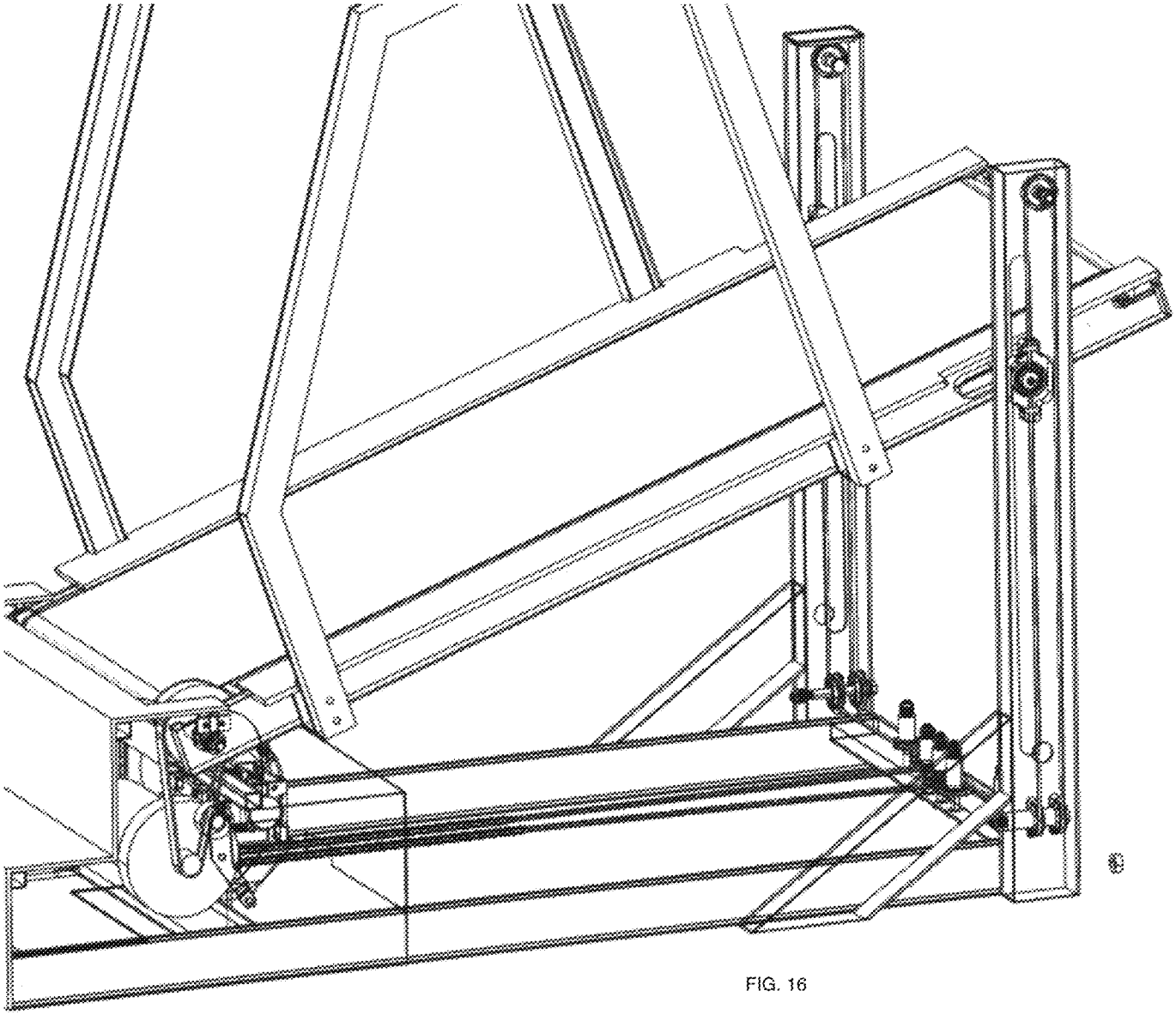
FIG. 16 depicts a detail view of the lifting mechanism of the embodiment shown in FIGS. 14-15.

FIG. 14 depicts a treadmill according to yet another embodiment. In the embodiment shown in this figure, the treadmill has a pivot point about the rear of the running belt. As may be understood from FIGS. 14-16, the treadmill includes a series of pulleys (e.g., or sprockets or other device) that cooperate to cause one or more cables (e.g., chains, or other connecting members) to raise and lower a front portion of the treadmill to cause an incline and/or decline.

Dual Belt Treadmill Configurations

Figure 17:
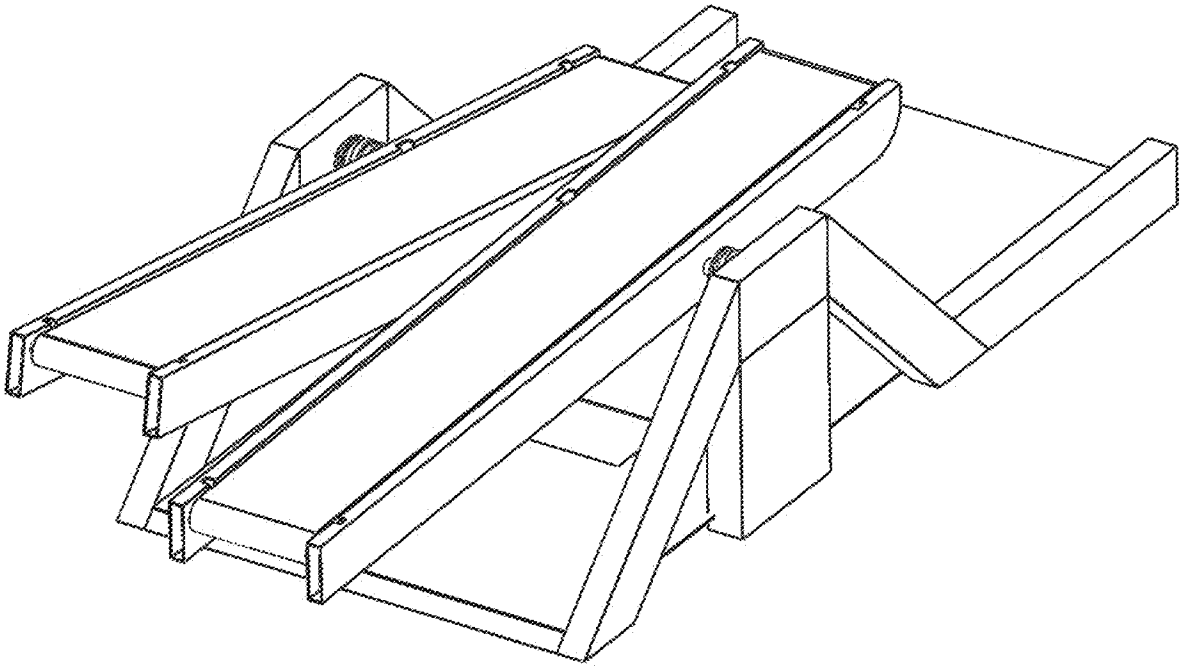
FIG. 17 depicts a dual belt treadmill according to particular embodiments.

In particular embodiments, the treadmill system comprises an independent right and left running belt (e.g., one belt for each foot of a runner). As may be understood from FIG. 17, the left and right running belts may be configured to have independent lifting mechanisms (e.g., any lifting mechanism described herein). In various embodiments, the system is configured to incline and decline independently in order to simulate different types of terrain, steps, etc. In particular embodiments, each of the independent belts may substantially automatically adjust to an incline level substantially instantaneously based on a position of an avatar within a rendered environment as described herein. On a flat running surface, each of the two running belts may be positioned substantially parallel to one another. In particular embodiments, the left and right running belt support systems may include one or more latching elements to at least temporarily engage with each other in order to ensure a flatter running surface (e.g., using one or more electromagnetic latches, or using any other suitable mechanism). In particular embodiments, a belt speed of each belt may be substantially synchronized. In still other embodiments, the belt speed of each independent belt may vary (e.g., in order to simulate slipping conditions, moving water, etc.).

Alternative Lifting Mechanism Embodiments

Figure 18:
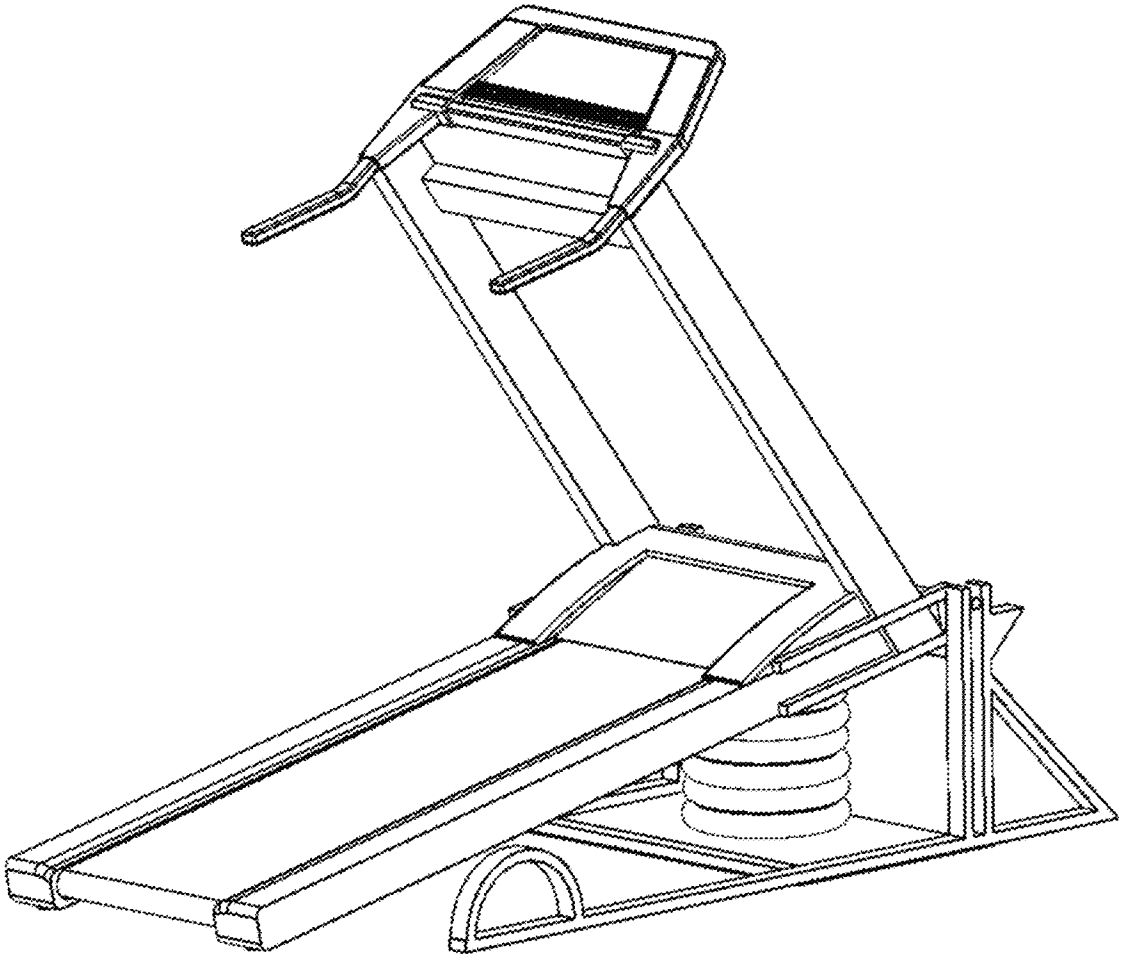
FIG. 18 depicts a treadmill according to another embodiment.
Figure 19:
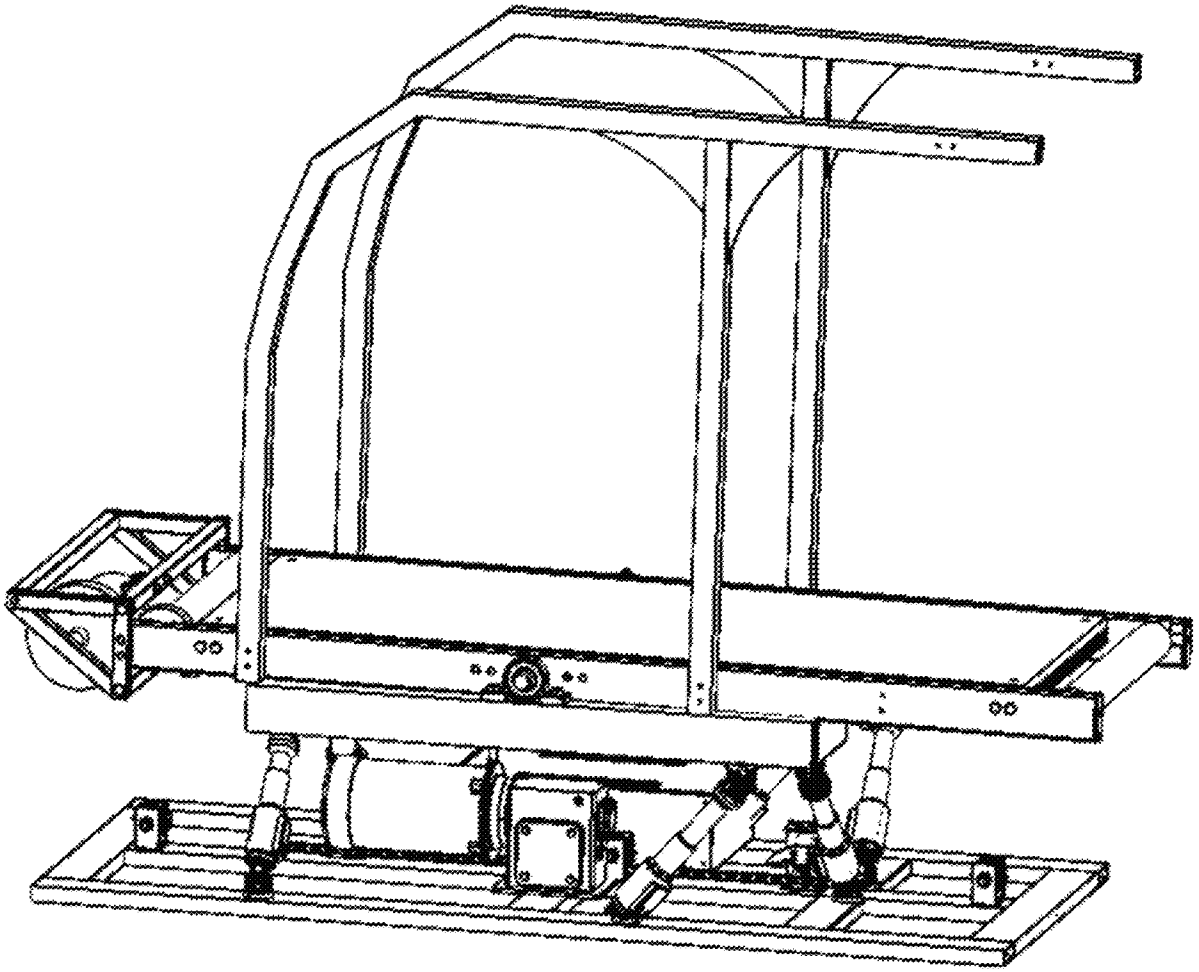
FIG. 19 depicts a treadmill according to yet another embodiment.
Figure 20:
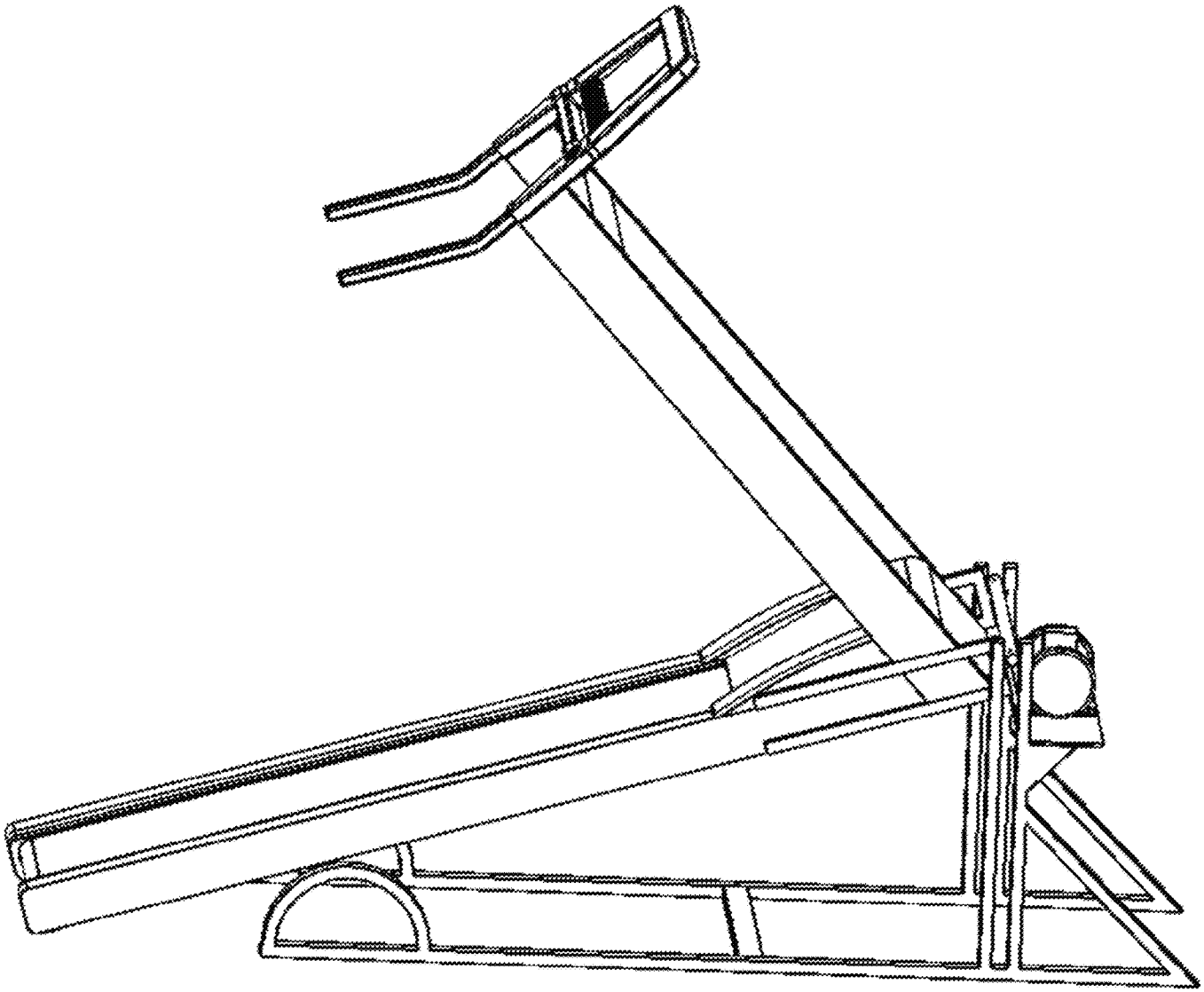
FIG. 20 depicts a treadmill according to still another embodiment.

FIGS. 18-20 depict treadmill systems according to particular embodiments. In the embodiment shown in FIG. 18, the treadmill system comprises a bellows configured to fill with a lifting bag (e.g., bellows) or combination of lifting bags. As may be understood from FIG. 18, the lifting mechanism may enable a rapid incline and/or decline of the treadmill running surface by manipulating an amount of air within the lifting bag. The system may, for example, include input and output valves configured to receive and expel air from within the lifting bag. The system may further comprise one or more pumps configured to pump and/or extract air from the lifting bag. In various embodiments, a group of treadmills may all be controlled through a centralized pumping system (e.g., as in a gym). In any embodiment described herein, the bellows or lifting bag may be configured to maintain the treadmill at a desired incline based on the terrain as described herein.

In the embodiment shown in FIG. 19, the treadmill comprises a plurality of linear actuators configured to cooperate to maintain the treadmill at a particular incline and/or pitch. In such embodiments, the linear actuators may serve as a Stewart platform. FIG. 20 depicts yet another embodiment of a treadmill system, in which an independent lifting mechanism is configured to support and provide lift to a third-party treadmill. In such an embodiment, a treadmill placed on the lifting platform may be configured to integrate with the treadmill system described herein, to provide rapid lifting functionality and incorporation with the virtual environments described herein.

Additional Embodiments of an Exercise Device

Figure 21:
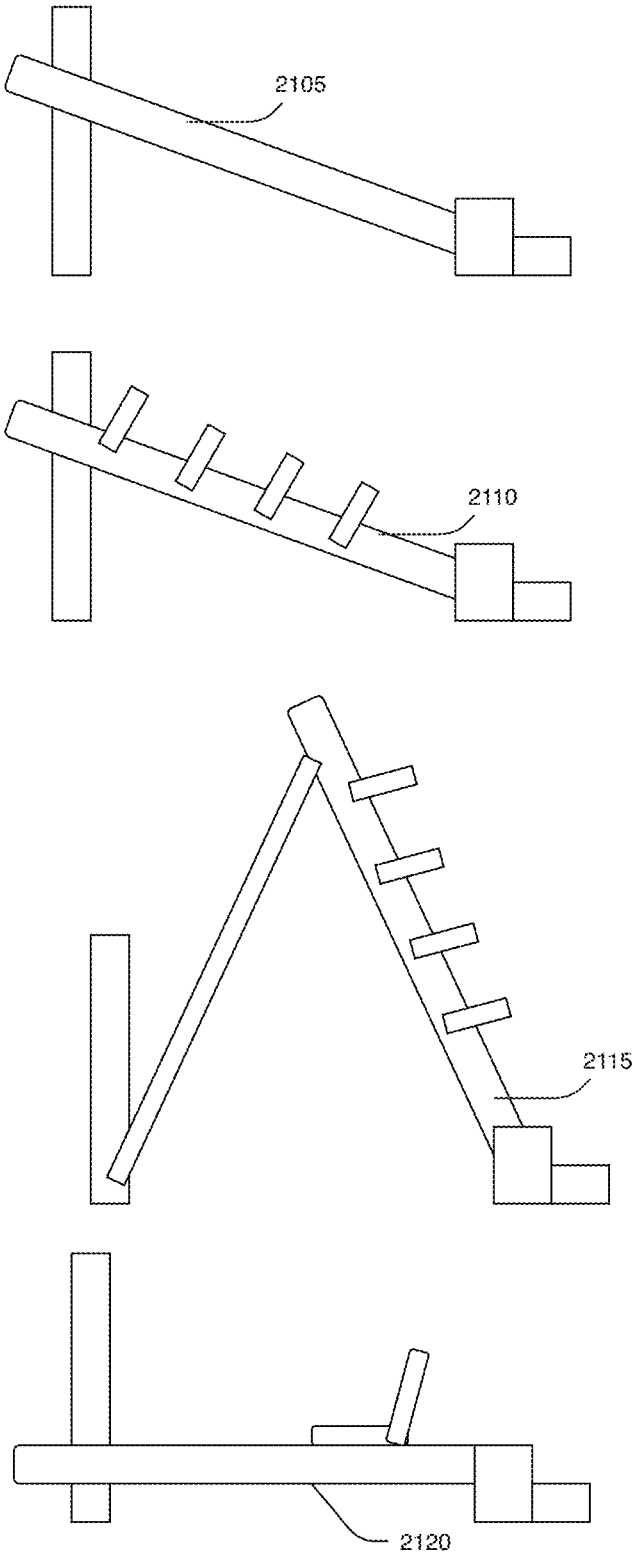
FIG. 21 depicts a plurality of system configurations according to various embodiments.

FIG. 21 depicts particular additional embodiments of the system, which may, for example, enable modification between various different types of devices in a single form factor. For example, various embodiments of the system may include a Jacob's ladder 2110 or stair-stepper type device. Other embodiments may include a climbing wall 2115 (e.g., by replacing a treadmill belt with a belt containing a plurality of hand holds, and angling the device more severely upward (e.g., such that the infinite climbing wall is positioned in an upward configuration to enable simulated climbing). In a particular embodiment, the system may be configured to include a stair stepper type Jacob's ladder arrangement, in which the treadmill belt has been replaced by a Jacob's ladder type belt containing one or more rungs or hand holds configured to enable a user to climb as the belt rotates about the one or more rollers (e.g., which may be powered by respective motors).

In particular embodiments, the system comprises a quick-cassette system configured to enable a user to change from one implementation to another substantially on-the-fly. For example, the system may comprise one or more rollers around which a user can place a desired deck type (e.g., treadmill, Jacob's ladder, climbing wall, rowing apparatus, etc.). The user may, for example, remove a particular cassette type from the lifting mechanism and rollers and replace it with a desired cassette type. The system may, for example, include a quick release mechanism for detaching a currently installed cassette type in favor of another type.

Figure 22:
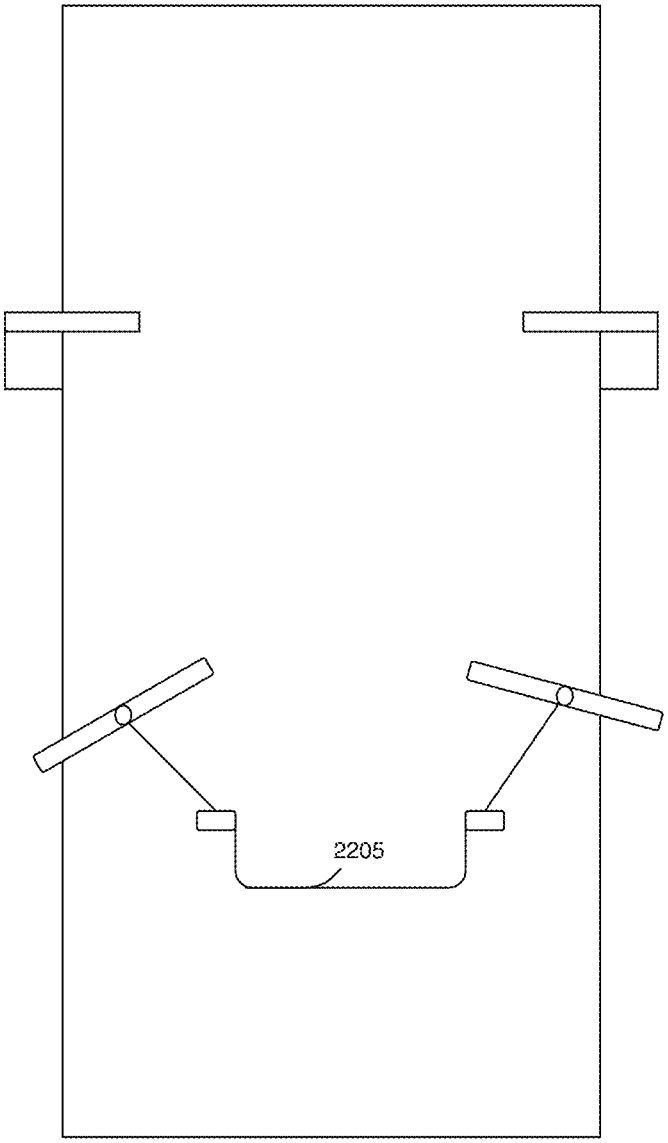
FIG. 22 depicts an exemplary embodiment of a rowing simulation system according to various embodiments.

FIG. 22 depicts an additional embodiment of a rowing simulation system according to particular embodiments. In various embodiments, the rowing simulation system may be configured to include a seat 2205 which may, for example, attach to (e.g., at least temporarily affix to) a treadmill-like belt. In various embodiments, the rowing simulation system may further comprise a rope that extends from respective uprights to a handle that the user may hold with each hand in order to simulate a rowing motion.

In particular embodiments, the rowing simulation system may incorporate various aspects of the treadmill system described herein. For example, in particular embodiments, the treadmill belt is configured to move back and forth (e.g., as opposed to continuously in one direction) in order to simulate rowing motion. In various embodiments, the system is configured to adjust a rowing force by modifying a pulling force required by the user against the one or more pulleys in addition to the push and pull of the belt. In still other embodiments, the system would be configured to implement a more realistic paddling system by, for example: (1) providing an electromagnetic rowing joint configured to control oar resistance, which may, for example, determine position and velocity with six degrees of freedom; (2) determining an angle of a user's hand while rowing (e.g., at various positions during a stroke); and (3) use hand and oar angle data to more accurately affect input to a virtual rowing simulation based on rowing power, angle, etc.

In a particular embodiment, the system may, for example, translate a deeper stroke at a particular angle with respect to the water with a greater forward thrust in a virtual rowing simulator. In particular embodiments, the system is configured to enable independent hand motion (e.g., in the context of a kayak simulation). In various embodiments, each handle provides independent feedback, which may, for example, require a user to provide more precise input to row in a straight line (e.g., than a traditional rowing motion with a single pulley for example). In some embodiments, the system comprises multiple pulleys that are independently operated by respective handles (e.g., via one or more respective stanchions). The rowing simulation may be further understood from FIG. 22.

Bicycle Riding System

A bicycle riding system, according to various embodiments, is configured to simulate a substantially realistic bicycle riding experience on a substantially stationary platform. The system may, for example, include a bicycle riding device configured to support a bicycle while the bicycle riding device adjusts a position and orientation of the bicycle (e.g., the front of the bicycle, the rear of the bicycle, etc.). In particular embodiments, the system may be configured to manipulate one or more bicycle support mechanisms (e.g., rollers) via a combination of one or more motors and other components in order to adjust a position, angle, relative position, height, slope, slant, etc. of each bicycle support mechanism (e.g., for both the front and rear tires). In particular embodiments, the system is configured to manipulate a bicycle support surface based on terrain data. The system may, for example, be configured to adjust a simulated position and orientation of a supported bicycle based on terrain data that corresponds to a virtual terrain. The system may further manipulate the simulated bicycle position based on pedal speed, handlebar angle, lean of the rider, etc. In various embodiments, the system includes a virtual simulation in addition to a physical simulation, in which an avatar representing the rider traverses a terrain while the rider experiences changes in terrain on the bicycle riding device As may be shown in FIGS. 23-25, various embodiments of a bicycle riding device 300 may be configured to support a bicycle (e.g., with a rider on the bicycle) while using one or more mechanisms to manipulate a position of the bicycle within the bicycle riding device 300. For example, in the embodiment shown in FIG. 23, the bicycle riding device 300 comprises a front wheel manipulation mechanism 310 and a rear wheel manipulation mechanism 320. In the embodiment shown in this Figure, the front wheel manipulation mechanism 310 may include: (1) a front wheel support 312; and (2) one or more motors 330. As may be understood from FIG. 3, the front wheel support 312 may be configured to support a front wheel of a bicycle and may, for example, include one or more lateral support members 313 configured to maintain the front wheel of the bicycle within the front wheel support 312 (e.g., such that the front wheel support 312 at least partially prevents lateral movement of the front wheel using the one or more lateral support members 313 while the front wheel support 312 is supporting the front wheel). In particular embodiments, the one or more motors 330 are configured to modify a position of the front wheel support 312 such that a position of the bicycle's front wheel (e.g., and the bicycle) are manipulated while the bicycle riding device 300 is supporting the bicycle. In this way, the bicycle riding device 300 may be configured to manipulate a height and angular position of the front wheel of the bicycle.

In various embodiments, the one or more motors 330 are configured extend and retract respective cables 350 (e.g., strings, chains, ropes, or other suitable substantially rigid members), which may, for example, be operably connected to both a respective motor of the one or more motors 330 and the front wheel support 312 via one or more pulleys 340. As may be understood in light of this disclosure, the one or more motors 330 may be configured to manipulate a position of the front wheel support 312 by extending and retracting different support cables 350 to cause relative movement of different corners of the front wheel support 312. In this way, the bicycle riding device 300 may be configured to manipulate a height and angular position of the front wheel support 312. In still other embodiments, the bicycle riding device 300 may utilize any other suitable mechanism for manipulating a height, position, and angle of the front wheel support. The system may for example, utilize one or more linear actuators (e.g., positioned on respective corners of the front wheel support), one or more levers, and/or any other suitable mechanism or combination of mechanisms to affect a desired movement and orientation of the front wheel support. As may be understood from FIG. 3 and this disclosure, manipulation of the front wheel support may adjust a position of the bicycle (e.g., the front wheel of the bicycle) such that a rider of the bicycle may experience a change in orientation that adjusts an experience of the rider riding the bicycle.

Figure 23:
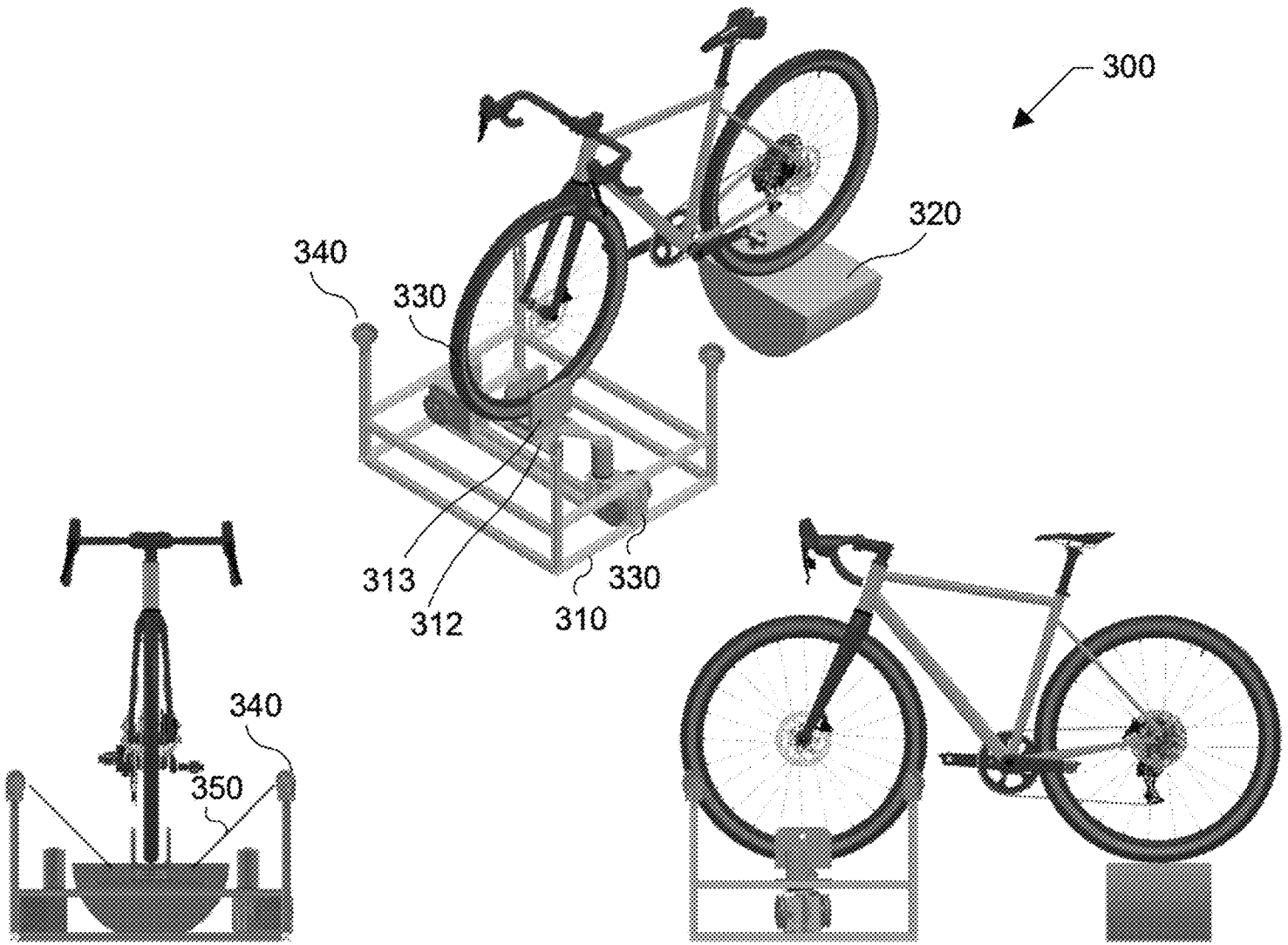
FIG. 23 depicts a bicycle riding device 300 according to a particular embodiment.

As may further be understood from FIG. 23, the rear wheel manipulation mechanism 320 is configured to tilt in a direction perpendicular to the rear wheel. In this way, the bicycle riding device is configured to cause the rear wheel of the bicycle to traverse a width of the rear wheel manipulation mechanism 320. In particular embodiments, the bicycle riding device 300 may include any combination of wheel support and/or manipulation mechanisms. For example, the bicycle riding device 300 may include a rear manipulation mechanism 320 that is structurally similar to (e.g., identical to) the front wheel manipulation mechanism 310 described above. In still other embodiments, the bicycle riding device 300 may include a front manipulation mechanism 310 that is structurally similar to (e.g., identical to) the rear wheel manipulation mechanism 320 described above.

Figure 24:
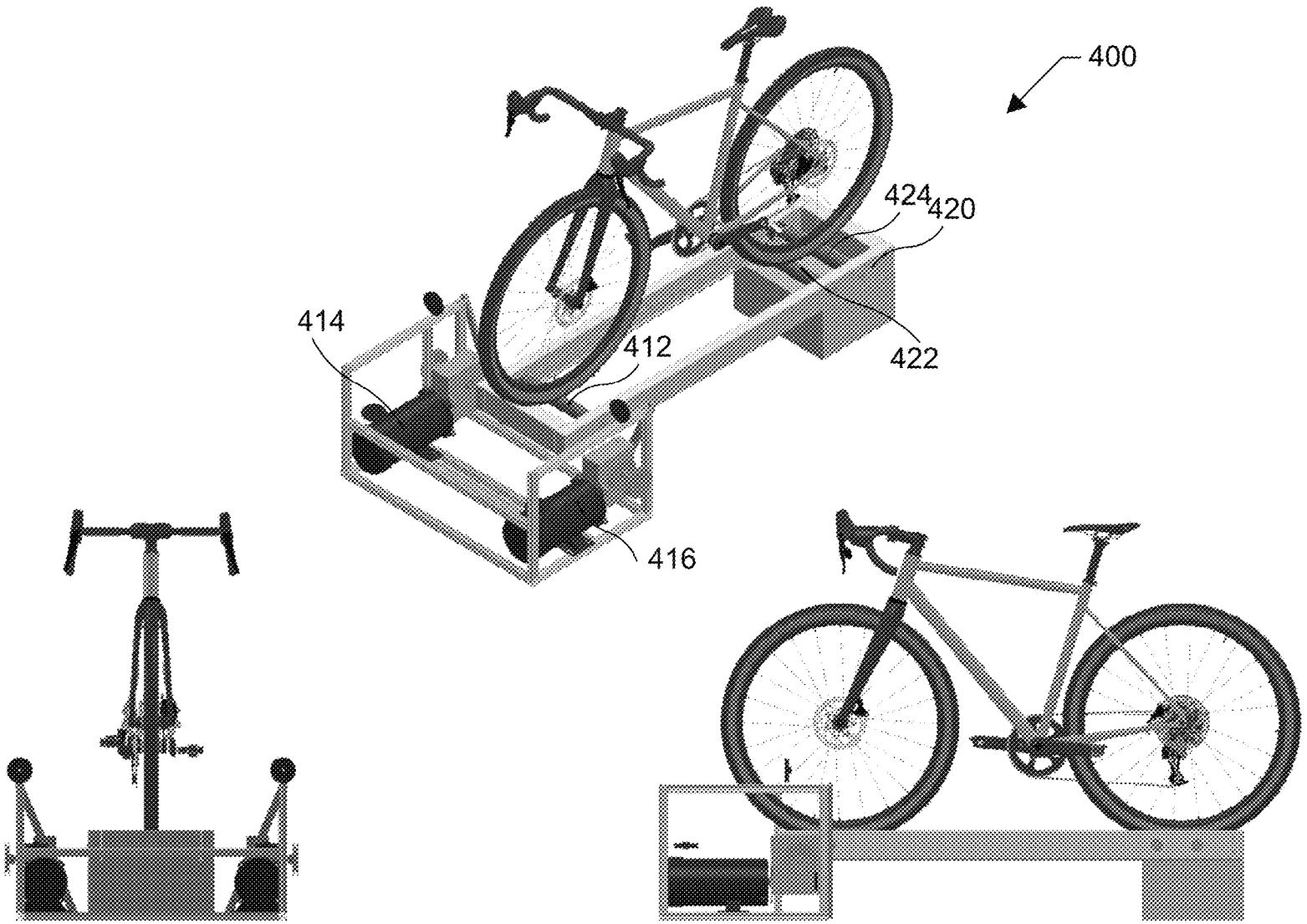
FIG. 24 depicts a bicycle riding device 400 according to another embodiment.

Turning to FIG. 24, a bicycle riding device 400 according to yet another embodiment may include: (1) a front wheel manipulation mechanism 410; and (2) a rear wheel manipulation mechanism 420. In the embodiment shown in FIG. 24, the front wheel manipulation mechanism 410, may include at least one roller 412, a first roller manipulation mechanism 414, and a second roller manipulation mechanism 416. In various embodiments, the at least one roller 412 may be configured to rotate about an axis of rotation of the at least one roller 412. In some embodiments, the at least one roller 412 may be configured to rotate substantially freely (e.g., spin freely). As may be understood from FIG. 24, the at least one roller 414 is configured to support a front wheel of a bicycle. In particular embodiment the at least one roller may be substantially cylindrical (e.g., cylindrical). In other embodiments, the at least one roller 414 may be at least partially flared (e.g., on opposing ends) to at least partially prevent the bicycle's front tire moving laterally beyond either side of the at least one roller (e.g., and potentially falling off of the at least one roller 412). In particular embodiments, the at least one roller 112 may include a first and second flared collar, which may, for example be adjustable. In some embodiments, by adjusting the flared collars closer together on the roller, a rider may enjoy an easier ride in which the bicycle's front tire is supported closer to a center of the at least one roller 112. In still other embodiments, adjusting the flared collars outward on the at least one roller 112 may enable a rider to experience a more difficult ride in which the front tire of the bicycle can traverse a larger width of the at least one roller 112.

In various embodiments, the front wheel manipulation mechanism 410 includes a first roller manipulation mechanism 414 and a second roller manipulation mechanism 416. As may be understood in light of this disclosure, the first and second roller manipulation mechanisms 414, 416 are configured to manipulate a position of respective ends of the at least one roller 412. For example, the first roller manipulation mechanism 414 may be configured to raise and lower a first end of the at least one roller 412, and the second roller manipulation mechanism 416 may be configured to raise and lower a second end of the at least one roller 412. In this way, the front wheel manipulation mechanism 410 may be configured to provide a lifted, lowered, and/or slanted riding surface for the front tire of the bicycle.

In various embodiments, a rider of the bicycle may need to steer the front tire to compensate for the tilt of the at least one roller 412 while riding the bicycle on the bicycle riding device (e.g., in order to maintain the front tire on the at least one roller 412). In various embodiments, each of the first roller manipulation mechanism 414 and the first roller manipulation mechanism 416 may include one or more motors, pulleys, cables, brackets or other suitable mechanisms for affecting the desired lifting and lowering of the at least one roller 412. In particular embodiments, the first roller manipulation mechanism 414 may, for example, include a spring configured to at least partially dampen and/or neutralize a load on the at least one roller 412 (e.g., due to the weight of the bicycle and rider). In some embodiments, the spring (e.g., one or more springs) may be configured to cooperate with the one or more motors to facilitate a smoother lifting of either end of the at least one roller 412. In still other embodiments, the spring is configured to at least partially compress when the bicycle is lowered such that when the one or more motors are lifting the at least one roller back up 412, the force of the spring cooperates with the one or more motors to provide a lifting force to the first end of the at least one roller. In various embodiments, the first and second roller manipulation mechanisms may be substantially structurally similar (e.g., identical).

Referring again to FIG. 24, the bicycle riding device 400 further includes a rear wheel manipulation mechanism 420. As may be understood from this figure, the rear wheel manipulation mechanism 420 includes a first roller 422 and a second roller 424. In various embodiments, the first and second rollers 422, 424 may cooperate to maintain the rear wheel of the bike between the first and second rollers 422, 424, which may, for example, support the rear wheel of the bicycle. In various embodiments, the first and second rollers 422, 424 may be substantially free spinning. In still other embodiments, the rear wheel manipulation mechanism 420 may be configured to provide a free wheel mode. In various embodiments, a user riding a bicycle outdoors may experience situations in which the rider is not pedaling but the bike (e.g., and the wheels) are still rolling. In particular embodiments, the rear wheel manipulation mechanism 420 includes one or more motors configured to rotate one or both of the first and second rollers 422, 424. For example, the system may be configured to cause the one or more motors to rotate one or both of the first and second rollers 422, 424 to provide rolling motion to the rear wheel. In this way, the rear wheel manipulation mechanism 420 may simulate coasting on a bicycle without pedaling. In various embodiments, the rotation of one or both of the first and second rollers 422, 424 may be sufficient to enable a rider to balance on the bicycle without pedaling, while being in a stationary position.

In various embodiments, the system may comprise one or more sensors configured to detect a pedal rate (e.g., pedal power) of the bicycle (e.g., using one or more encoders in the first and/or second rollers 422, 424, one or more accelerometers, etc.). In particular embodiments, the system may comprise one or more controllers configured to cause the one or more motors to cause one or both of the first and second rollers 422, 424 to rotate at a rate based at least in part on a determined rate of pedaling of the bicycle. In this way, the system may be configured to compensate for a lower pedal rate with an 'assist' provided by the one or more motors and rollers. FIG. 8 depicts additional views of the rear wheel manipulation mechanism 420. In particular embodiments, the controller is configured to provide a sufficient roller rotation required for a rider to maintain balance (e.g., through a combination of rotation provided by the user pedaling and the rotation caused by the one or more motors). In particular embodiments, the system may be configured to determine a rotation speed to be provided by the one or more motors based on any suitable factor such as, for example: rider momentum, grade (e.g., based on terrain as will be discussed more fully below), and/or any other suitable factor. In various embodiments, the free-wheeling feature may enable a rider to relax while travelling 'down hill' or coasting, and further enable a rider to avoid having to pedal the entire time the rider is using the bicycle riding device 400.

In particular embodiments, the bicycle riding device 400 may include any suitable combination of wheel support and/or manipulation mechanisms described herein. For example, the bicycle riding device 400 may include a rear wheel manipulation mechanism 420 that is structurally similar to (e.g., identical to) the front wheel manipulation mechanism 410 described above. In still other embodiments, the bicycle riding device 400 may include a front manipulation mechanism 410 that is structurally similar to (e.g., identical to) the rear wheel manipulation mechanism 420 described above. In still other embodiments, the bicycle riding device may include any suitable combinations of front and rear manipulation mechanisms described herein.

Figure 25:
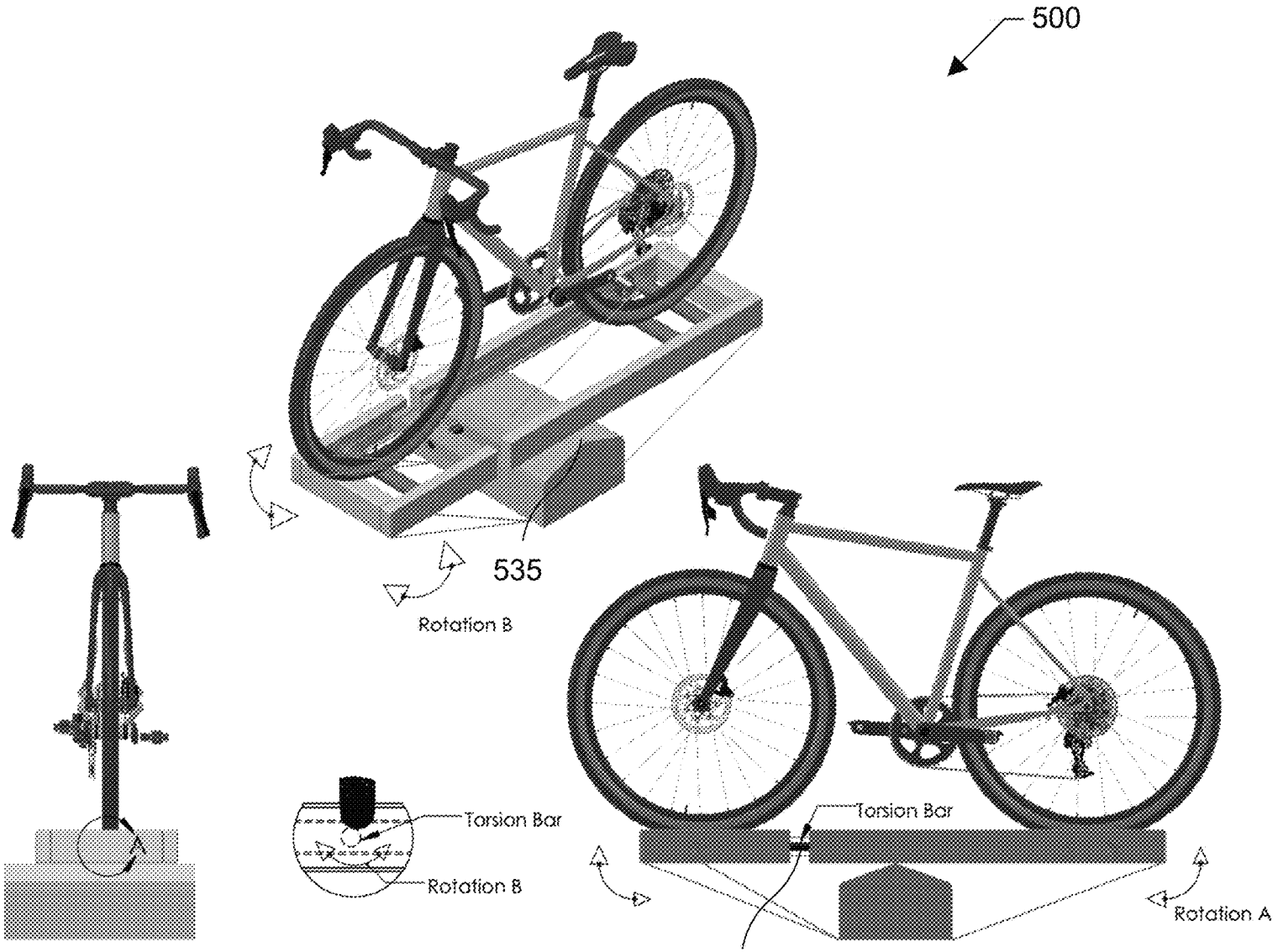
FIG. 25 depicts a bicycle riding device 500 according to yet another embodiment.

Turning to FIG. 25, in various other embodiments of a bicycle riding device 500, the device may include a torsion bar 525 configured to provide a rotation such that the device adjusts an angle between the at least one front roller and the first and second rear rollers. In this way, the device may be configured to simulate further types of terrain by adjusting a relative angle of the front and rear wheel. The torsion bar 525 may, for example, enable the front of the bike to twist independently from the rear of the bike while the bicycle riding device 500 is supporting the bicycle. In still other embodiments, the system includes a see-saw mechanism 525 that may, for example, increase a range of motion of the lifting mechanisms. For example, the system may independently lift the front of the bike by five degrees while lowering the rear of the bike by five degrees in order to provide a mechanical advantage to the lifting mechanism. This may, for example, further reduce a footprint of the bike riding device 500.

In particular embodiments, any of the rollers described herein may be configured to simulate different riding surfaces. For example, the one or more rollers may include one or more knobby rollers, for example, to simulate gravel or other surfaces. In still other embodiments, the system may comprise interchangeable rollers, which may, for example, comprise different surfaces (e.g., different surface configurations, different surface coefficients of friction, etc.). In this way, the system may be configured to simulate different surfaces (gravel, sand, wet surfaces, asphalt, dirt, etc.) through combinations of different rollers.

Figure 28:
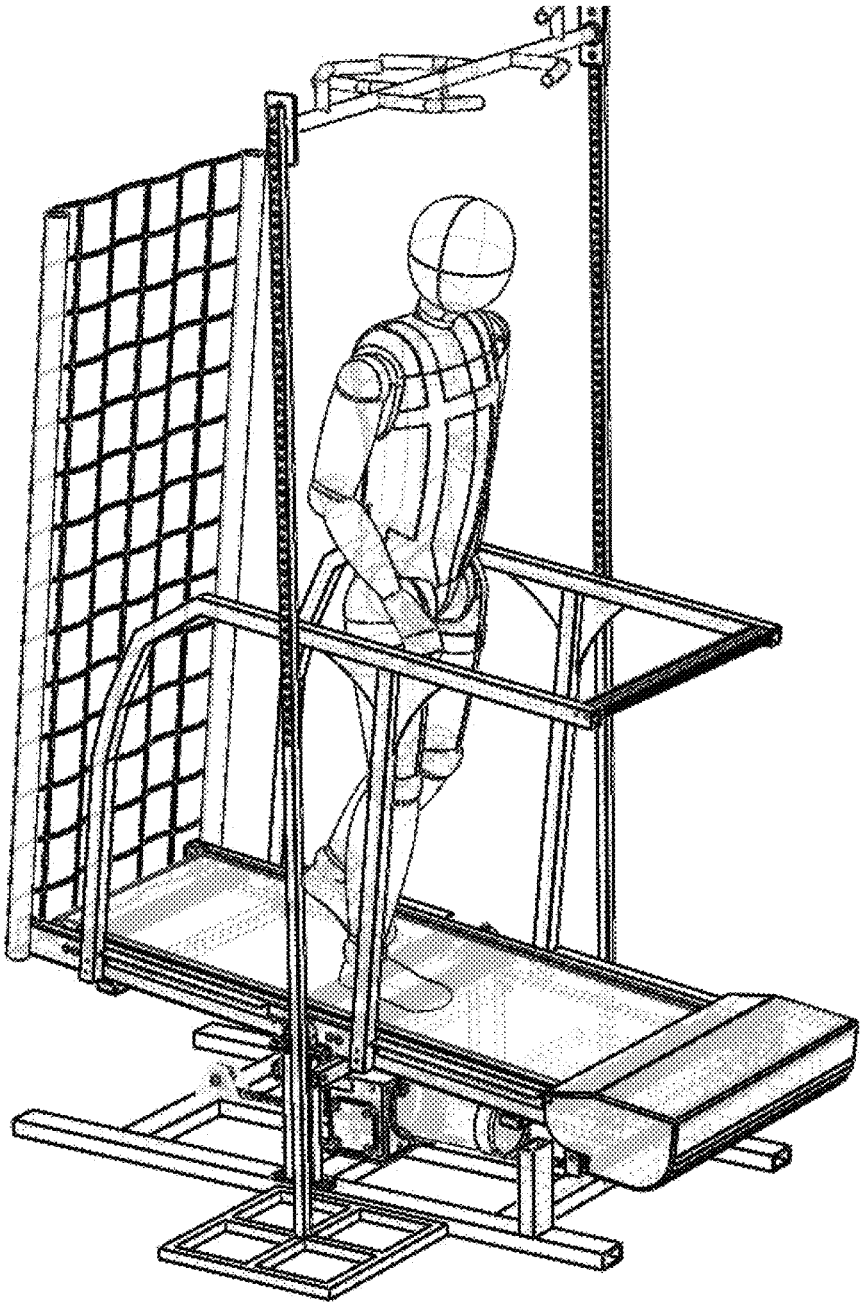
FIG. 28 depicts a treadmill system according to another embodiment.

FIGS. 26-28 depict additional embodiments of a bicycle riding device. In various embodiments, the bike riding device may include a tread that extends between one or more front and rear rollers. In such embodiments, the system may enable a runner to run along the tread surface. In particular embodiments, the system is configured to substantially automatically speed up and slow down in response to identifying a change in running speed of the runner (e.g., and/or rider). The system may, for example, determine a change in distance of the runner/rider from the front of the device and speed up and/or slow down the belt in order to maintain the rider/runner in a desired location in the belt (e.g., as the runner is running and/or rider is riding). In this way, the system may be configured to avoid having to require a user to manually modify a speed of the belt. The system may, for example, use software to keep the runner in the center of the belt, by identifying a slow down in the user's gait (e.g., using one or more imaging devices, such as a Microsoft Kinect).

As may be understood from these figures, in various embodiments, the device may include a rear tire support configured to attach adjacent opposing portions of a rear tire axle. In various embodiments the rear tire support is configured to support the bicycle in an upright position. In various embodiments, the rear tire support is configured to traverse between opposing sides of the device (e.g., along one or more shafts). In still other embodiments, the rear tire support is configured to tilt (e.g., up to about 45 degrees). In various embodiments, the rear tire support includes a mechanism for adjusting a maximum tilt of the support. In this way, the system may be configured to enable a rider to lean into a turn without risking having the bike fall over.

Exemplary Treadmill Mechanics

In particular embodiments, the system is configured to simulate one or more actions in addition to walking/running on a flat/incline/or declined surface. For example, in a particular embodiment, the system is configured to simulate pushing an object (e.g., such as a sled) by: (1) stopping the rotation of the running belt; (2) directing the player to push the belt through their own force; (3) received rotational input of the belt from the user (e.g., as the user holds one or more hand supports and pushes the belt with alternating feet; and (4) in response to the belt rotation, causing the player's avatar to move within the virtual environment while pushing an object with which the avatar is interacting.

In still other embodiments, the system is configured to simulate jumping by detecting the player being positioned high enough off of the running belt for at least a certain amount of time. The system may identify jumping using one or more pressure sensors, imaging devices, IR sensors, or any other suitable sensor. In particular embodiments, the player may hold onto one or more handrails and support their body weight while lifting their feet at least temporarily off of the running surface to cause their avatar to jump within the virtual terrain and in order to jump in a particular direction forward as well as upwards. In various embodiments, jumping may enable a player to control movement of their avatar within the virtual environment to traverse over obstacles, etc.

In still other embodiments, the system is configured to initiate a climbing simulation by: (1) increasing the incline to a maximum height; and (2) reducing a belt speed to a low speed or no speed. In this way, the system may simulate a slow climb, force the user to provide all of the force to move the belt on their own, etc. In yet another embodiment, the system may be configured to simulate wading (e.g., through water or another substance within the virtual environment) by, for example: (1) decline to the lowest angle based on the treadmill configuration; (2) set the belt speed to zero; and (3) receive user input causing the belt to spin (e.g., through the force of the user's legs). In various embodiments, the system may be configured to automatically increase an incline in response to a user increasing a force provided to the belt (e.g., as if the user were wading out of the environment). In still other embodiments, the system is configured to re-lower the treadmill in response to the user slowing down the force of input or stopping (e.g., to simulate sinking).

In still other embodiments, the system may be configured to simulate walking through shallow water by, for example, alternatingly slightly lowering and slighting raising the belt. This may for example, simulate a user needing to raise their feet higher to walk through shallow water. In additional embodiments, the system is configured to identify a particular user gesture input and interpret the input as a grabbing motion. This may enable the user to interact with objects within the virtual environment by making a particular gesture, positioning their hand in a particular manner, etc. Once grabbing an object, the user may, for example, perform an additional gesture in order to indicate pulling, throwing, or taking other actions with regard to the object in the environment. In this way, the system may require the user to move their body in particular ways in order to interact with the virtual environment. This may include, for example, collecting objects within the environment (e.g., by reaching their hand in a direction of the object relative to their avatar), avoiding particular elements within the environment, etc.

In various embodiments, the system is configured to use one or more machine learning techniques to identify particular player behavior based on the player's past interaction with and response to different environmental conditions. For example, the system may identify one or more patterns in how a user approaches a hill with a particular incline (e.g., in terms of speeding up and slowing down) and automatically modify a speed of the treadmill in response to a user approaching such a feature in the virtual environment. This may enable the user to interact with the environment without having to provide as much input with regard to speed adjustments, etc.

Additional Embodiments of User Control Systems

In particular embodiments, the system may be configured to utilize one or more additional forms of user input. For example, in various embodiments, the treadmill system may comprise one or more microphones (e.g., or other transducers for converting sound into one or more electrical signals). In such embodiments, the system may be configured to receive sound input (e.g., audio input) via the one or more microphones. The system may, for example, be configured to receive one or more vocal inputs from a user of the treadmill system.

In various embodiments, the system may be configured to receive and analyze audio (e.g., voice) input in order to interpret particular sounds as system inputs and perform one or more actions in response to those inputs. For example, in a particular embedment, the system is configured to identify one or more audio inputs using one or more natural language processing techniques (i.e., to identify a particular word or series of words in a piece of audio received by the system).

In particular embodiments, the system is configured to integrate with one or more virtual assistants, cloud-based voice services, etc. (e.g., Amazon Alexa, Siri, etc.). In various embodiments, the system is configured to utilize one or more application programming interfaces to leverage one or more cloud-based voice services to identify particular vocal inputs from a user of the treadmill. The system may then be configured to receive an identified command from the cloud-based voice service and perform one or more actions associated with the command.

For example, in various embodiments, the system may store one or more trigger words which may, for example, cause the system to perform a specific action in response to identification of a particular one of the one or more trigger words. In response to a particular excited utterance (e.g., 'wow', 'yikes', 'be careful', etc.), the system may be configured to generate a marker at that location at which the user made the utterance that provides information for other treadmill users when they navigate the virtual terrain in the same area. For example, in response to an utterance that indicates a warning, the system may generate a warning for users to be careful in a particular location (e.g., because of a sudden steep incline or other obstacle at that location). In other embodiments, the system may generate a marker indicating a particular interesting location within the virtual terrain that is worth viewing (e.g., a point of interest, waterfall, etc.).

In various embodiments, the system is configured to combine vocal input of the user with one or more gesture inputs in order to determine a user input. For example, the system may be configured to identify a user vocal input of "I want to take that trail" in combination with a gesture of the user pointing in a particular direction. In response, the system may be configured to cause the user's avatar to 'snap-to' a predefined path in the direction in which the user was pointing while giving the vocal command. In this way, the system may enable the user to provide more nuanced input that combines the user's vocal control and gesture inputs, without requiring the user to stop walking/running, push any buttons, etc. The system may, for example, identify user gestures and physical input using any suitable technique described herein.

In particular embodiments, the system may be configured to store location data based on vocal inputs in order to enable a user to easily return to a particular stored location within the virtual terrain (e.g., 'save this spot for later', etc.).

In still other embodiments, the system may be configured to receive user input based on one or more electrical signals from the user's brain and/or one or more muscles. For example, the system may be configured to interface with an EEG and/or EMG in to receive electrical brain activity and/or muscle activity. The system may then be configured to interpret particular electrical signals as particular system inputs.

Accessing Existing Trails within a Virtual Terrain

As discussed more fully above, in various embodiments, the system is configured to enable a user of the treadmill system to substantially freely (e.g., freely) navigate a virtual terrain while using gestures and other user input to change directions, speed up, slow down, and traverse the terrain while continuing to run/walk on the treadmill. In particular, the system is configured to enable such free movement while modifying the treadmill itself in response to terrain encountered by the user's avatar. As may be understood in light of this disclosure, by freely moving through the virtual terrain, the user may encounter terrain of varying degrees of difficulty (e.g., steep slopes, rough areas, areas of obstacles to overcome, etc.). As such, various users may desire to travel on predefined trails or paths rather than risking encountering terrain that is above the user's ability level.

In particular embodiments, the system may store predefined running/walking paths (e.g., through the virtual terrain) that enable a user to traverse the virtual terrain without having to provide direction input. In such embodiments, when travelling on a predefined path, the user's avatar may be configured to stay on the predefined path substantially automatically. For example, when travelling along a predefined path, the user may simply run and/or walk at their desired pace while navigating the changes in slope on the path, without having to cause the avatar to turn to the left or right in order to remain on the path.

In various embodiments, the system is configured to display an entrance to one or more paths within the virtual terrain as the user traverses the virtual terrain. In this way, the system may be configured to present a user with pre-set and other stored paths that the user may elect to take (e.g., using one or more voice commands) as the user encounters them. In other embodiments, the system is configured to enable a user to request to 'snap-to' the nearest available path. In still other embodiments, the system is configured to: (1) receive a request from the user to travel to a particular location; (2) automatically generate a path from the user's current location to the particular location; and (3) enable the user to travel along the generated path without having to provide directional input. In this way, the system may be configured to enable a user to switch between free-travel and trail-travel substantially on-the-fly. In still other embodiments, the system is configured to generate a requested path based on one or more user preferences. For example, the user may request to travel to a particular location using a path of easy, medium, or hard difficulty. In response, the system may generate the travel from the user's current location to a desired one based on the user's difficulty preference (e.g., avoiding difficult terrain for an easy path, and seeking it out for a hard one). In some embodiments, the system is configured to generate a most direct path to the desired location. In other embodiments, the system is configured to generate the shortest (e.g., in terms of time) path. In still other embodiments, the system is configured to generate a path based on any other suitable factor. FIG. 26 depicts an overhead view of a virtual terrain. As may be understood based on this disclosure, the system may generate and/or store path data through a particular terrain (e.g., which may correspond to a user-recorded path, an automatically generated path based on difficulty, etc.). When selecting a path, the user may view an overall terrain such as FIG. 26 to view the entirety of a path through the terrain when selecting a path.

In particular embodiments, the system is configured to enable a user to save a path that they have taken while moving freely through the virtual terrain in order to share the stored path with others. In such embodiments, the system may, in response to a user accessing a path created by a friend or other user, display a 'ghost' version of the path-creator's avatar as the second user traverses the path. In this way, the system is configured to enable one user to challenge a second user to take the same path while competing for time, etc.

In particular embodiments, the system is configured to store other data along with user-stored trail data such that other users can relive a first user's journey at a later time, complete with other data beyond the path taken by the user. For example, the system may be configured to store commentary and/or vocal inputs/narration provided by the creator of the trail so that later users that access the stored trail can hear information provided by the first user. In this way, a subsequent user accessing a trail may be able to completely relive a run/walk created by a first user as if the two users were experiencing the run together. In particular embodiments, the system is configured to store a ribbon of user data for a particular generated trail, which may include, for example: (1) location data within the virtual terrain over a particular length of time; (2) time-stamped vocal commentary; (3) time-stamped audio data for music and other ambient sounds heard by the user as the user traversed the virtual terrain to generate the trail; (4) vital signs and other data related to the user (i.e., heart rate); (5) pace data throughout the trail for the user that generated the trail; (6) instantaneous incline data throughout the trail (e.g., so a user deciding whether to select the trail can see how difficult the terrain is); and any other suitable data related to the trail and the creator's experience on it. In various embodiments, the system is configured to display the combined trail data as a ribbon that indicates points of interest, pace, and other data along the entire length of the trail. In some embodiments, the system is configured to provide the ribbon data (e.g., the visual representation of a run) to a medical professional for analysis as part of a physical rehabilitation.

In still other embodiments, the system may use one or more machine learning techniques to track user behavior in order to determine how a user handles particular interactions. For example, the system may be configured to learn a user's habits (e.g., using any suitable machine learning model) with regards to certain obstacles and automatically adjust the system based on those habits. In response to determining that a user typically slows down on a steep hill, the system may, for example, be configured to reduce a belt speed of the treadmill in response to a user reaching an area with a relatively steep incline.

Additional System Automation Based on User Data

In various embodiments, as described herein, the system is configured to track user data as the user uses the treadmill device. This may include, for example, vital signs and other data related to the user (i.e., heart rate). In particular embodiments, the system may be configured to automatically modify, or recommended modification to a user's path through the virtual terrain based on their heart rate and/or past performance data. For example, the system may be configured to manipulate the difficulty of the terrain that a user encounters (e.g., adjust a user's course through the terrain to include lower incline and/or decline) based on the user's heart rate. For example, the system may identify a target object within the virtual terrain for the user (e.g., based on user input, desired exercise time, desired exercise distance, etc.). The system may then determine, based on the user's heart rate, current distance from the objective, and terrain profile between the current position and the objective that, for example: (1) completing the current track to the desired objective may involve too much exertion for the user based on their ability level; (2) completing the current track to the desired objective may not involve enough exertion based on the user's typical exertion levels; etc. The system may then, in response to a determination discussed above: (1) automatically modify the user's path and/or objective; (2) recommend a modification to the user's path and/or objective (e.g., by displaying a recommended alternate path in the virtual terrain, which may include a more difficult or easier path to the objective); and/or (3) take any other suitable action to harmonize an estimated total activity output for the user with at least one of: (1) the user's typical performance; (2) the user's maximum performance; (3) the user's historical performance; (4) the user's provided desired exertion level; (5) etc.

In particular embodiments, the system is configured to selectively display alternate paths for the user through the virtual terrain, which may correspond to different effort levels required, difficulty to complete, change in altitude, shortest distance, etc. In displaying the alternate paths, the system may be configured to provide data for each path such as, for example: (1) total elevation change; (2) total distance; (3) number of interactions encountered (e.g., water, logs, jumps, etc.); (4) estimated time (e.g., based on current pace, historical average pace, etc.); (5) maximum incline data; (6) maximum decline data; and/or (7) any other suitable data related to any optional path. In this way, the system may be configured to display on screen directions (e.g., in the form of a virtual line or other indicator) that the user can select from (e.g., and follow) in order to achieve their desired goal during a particular activity. In some embodiments, the system may be configured to 'snap' the user to the selected line. In other embodiments, the user may need to direct and steer their avatar along the line (e.g., using any suitable input technique described herein). In particular embodiments, the system may generate a user interface indicating an 'effort' or 'power' level that the user is currently producing. In such embodiments, the system may determine 'effort' and/or 'power' based on one or more of a user's prior performance metrics (e.g., top speed, average speed, max incline, max decline, average incline, most obstacles encountered and navigated, etc.). In this way, a user can customize a particular activity (e.g., workout) based on their goals for that activity.

Ambient Sound and Other Audio Output

In particular embodiments, the system is configured to play one or more sounds as the user traverses the virtual environment. In particular embodiments, the one or more sounds may be based on one or more factors within the virtual terrain such as: (1) location (e.g., proximity to one or more sound-producing features within the terrain such as waterfalls, rivers, wildlife, etc.); (2) running surface within the virtual terrain (e.g., wet pavement causing splashing on footstep, leaves causing crunching, snow, puddles, etc.); and (3) any other suitable factors. In various embodiments, the system may be configured to identify the user's actual footstep on the belt using any sensor or technique described herein, in order to time a sound effect (e.g., crunch, splash, etc.) with the step of the user.

In various embodiments, the system may be configured to play one or more pieces of ambient music that the system is configured to modulate (e.g., automatically) based at least in part on: (1) a user's running/walking pace; (2) a current incline; (3) a proximity to the top of a climb; (4) an appearance within the terrain of a particular feature; (5) etc. In various embodiments, the modulation of the ambient music may include, for example: (1) a change in volume (e.g., up or down); (2) a change in beats per minute; (3) etc. In various embodiments, the system is configured to match a beat per minute of any ambient music to a running pace of the user of the treadmill. In still other embodiments, the system is configured to set a music beat per minute that is just above the running pace of the user. This may, for example, encourage the runner to continue to increase their speed (e.g., and therefore get more out or the run from an exercise perspective).

In particular embodiments, the system is configured to automatically change one or more audio features substantially instantaneously as the user's location, speed, direction, etc. change within the virtual terrain based on any feature described herein. In still other embodiments, the system is configured to cause one or more changes to the treadmill system based on one or more audio cues (e.g., by increasing or decreasing the speed of the belt, such as while the user runs over leaves or in snow, etc.).

Alternative Embodiments

In particular other embodiments, in addition to the various exercise devices described herein, the system may be embodied as any of: (1) an arcade machine (e.g., such as an arcade rideable vehicle such as a motorcycle or car; (2) a driving simulator; and/or (3) any other device or system which may benefit from the use of any of the user input system (e.g., gesture control, etc.) or user feedback systems (e.g., physical manipulation of an angle of incline, tilt, speed, etc. of a physical device) described herein. In yet another embodiment, the system may include the use of an arcade gun (e.g., light gun) or other input device configured to provide additional functionality to the system (e.g., such as an embodiment in which a user traverses a virtual terrain using the treadmill while shooting enemies).

In still other embodiments, the exercise device may incorporate any other suitable piece of exercise machinery or be configured to integrate with any other suitable piece of exercise equipment. For example, in any embodiment described herein, the system may include one or more attachment points (e.g., hooks, carabiners, holes, etc.) for attaching one or more cables or other devices which may provide additional exercise functionality to a user. In a particular embodiment, the system may include a pull rope or other pulling mechanism for use by the user when encountering particular environmental features in the virtual environment. In still other embodiments, the system may comprise one or more latching or other mechanisms for attaching one or more pull-up bars or other pieces of equipment. In particular embodiments, the system may include one or more pull up bars coupled to a safety bar of the treadmill device. FIG. 28 depicts an exemplary embodiment in which a pull up bar is integrated into the device. As may be understood form FIG. 28, the system may further include one or more safety mechanisms (e.g., such as a safety net). In still other embodiments, the system may include a hardness or other safety belt device.

In any other embodiment described herein, the system may be configured to interface with or incorporate any other suitable exercise or other device or equipment.

CONCLUSION

Many modifications and other embodiments of the invention will come to mind to one skilled in the art to which this invention pertains having the benefit of the teachings presented in the foregoing descriptions and the associated drawings. While this specification contains many specific embodiment details, these should not be construed as limitations on the scope of any invention or of what may be claimed, but rather as descriptions of features that may be specific to particular embodiments of particular inventions. Certain features that are described in this specification in the context of separate embodiments may also be implemented in combination in a single embodiment. Conversely, various features that are described in the context of a single embodiment may also be implemented in multiple embodiments separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination. For example, particular embodiments referring to certain components in various positions on the device may, in other embodiments, include other components described herein in any suitable combination.

Similarly, while operations are depicted in the drawings in a particular order, this should not be understood as requiring that such operations be performed in the particular order shown or in sequential order, or that all illustrated operations be performed, to achieve desirable results. Additionally, while some steps may be described as occurring in response to (e.g., or at least partially in response to) particular other steps, it should be understood that, in other embodiments, such steps may occur independent of (e.g., or coincident with) one another. In certain circumstances, multitasking and parallel processing may be advantageous. Moreover, the separation of various system components in the embodiments described above should not be understood as requiring such separation in all embodiments, and it should be understood that the described program components and systems may be generally integrated together in a single software product or packaged into multiple software products.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation. For example, as a user's avatar encounters a virtual terrain that has a particular incline level, the system may be configured to automatically modify an incline of the treadmill in response (i.e., the system may be configured to automatically modify the incline based on the incline of the virtual terrain). In this way, the system may be configured to simulate, via physical manipulation of the tread, a running/walking/jogging experience that substantially mirrors the terrain that a user's avatar is traversing through the virtual terrain.

It should be further understood that any particular feature (e.g., lifting mechanism) described with respect to any embodiment may be implemented in any other embodiment described herein (e.g., or in combination with other lifting mechanisms).

What is claimed is:

1. A treadmill comprising:

a front end;

a rear end;

a belt defining a running surface that extends substantially between the front end and the rear end;

one or more lifting mechanisms configured to adjust an orientation of the running surface about a pivot point positioned between the front end and the rear end, wherein the one or more lifting mechanisms comprise:

a first motor;

a first connector operatively connecting the first motor to a first portion of the treadmill adjacent the front end;

a second motor; and a second connector operatively connecting the second motor to a second portion of the treadmill adjacent the rear end; and computing hardware configured to control each of the first motor and the second motor to adjust a length of the first connector and the second connector to adjust the orientation of the running surface about the pivot point, wherein:

the first connector operatively connects the first motor to the first portion of the treadmill via at least one rotating connector; and the at least one rotating connector comprises at least one of a sprocket or a pulley.

2. The treadmill of claim 1, wherein the pivot point is disposed in a central position between the front end and the rear end.

3. The treadmill of claim 1, wherein each of the first connector and the second connector comprise at least one of a rigid connector, a semi-rigid connector, a chain, or a cable.

4. The treadmill of claim 1, wherein the computing hardware is further configured to automatically adjust the orientation of the running surface about the pivot point in response to a particular stimulus.

5. The treadmill of claim 1, wherein the first motor and the second motor are disposed below the belt.

6. The treadmill of claim 1, further comprising a gearbox configured to apply holding torque to the first connector.

7. The treadmill of claim 1, wherein the computing hardware is further configured to receive incline data and automatically adjust the orientation of the running surface about the pivot point based on the incline data.

8. A treadmill comprising:

a front end;

a rear end;

a belt defining a running surface that extends substantially between the front end and the rear end;

one or more lifting mechanisms configured to adjust an orientation of the running surface about a pivot point positioned centrally between the front end and the rear end; and computing hardware configured to control the one or more lifting mechanisms to adjust an incline level of the running surface about the pivot point, wherein:

the one or more lifting mechanisms comprise:

one or more motors; and one or more connectors operatively connecting the one or more motors to a first portion of the treadmill adjacent the front end or the rear end, the one or more connectors comprising at least one of a cable or a chain; and the computing hardware is configured to operate the one or more motors to adjust a length of the one or more connectors to adjust the incline of the running surface about the pivot point.

9. The treadmill of claim 8, wherein:

the one or more connectors operatively connect the one or more motors to the first portion of the treadmill adjacent the front end;

the one or more connectors operatively connect the one or more motors to a second portion of the treadmill adjacent the rear end; and the computing hardware is configured to control the one or more motors to adjust the length of the one or more connectors to adjust the orientation of the running surface about the pivot point.

10. The treadmill of claim 9, wherein the one or more connectors comprise:

a first connector that operatively couples the one or more motors to the first portion; and a second connector that operatively couples the one or more motors to the second portion.

11. The treadmill of claim 10, wherein the one or more motors comprise:

a first motor that is operatively coupled to the front end via the first connector; and a second motor that is operatively coupled to the rear end via the second connector.

12. The treadmill of claim 8, wherein the one or more connectors are operatively couple the one or more motors to the first portion via one or more rotating connectors.

13. The treadmill of claim 8, wherein the one or more lifting mechanisms further comprise one or more gearboxes configured to engage at least a portion of the one or more connectors.

14. The treadmill of claim 8, wherein the one or more connectors comprise at least one chain tensioner.

15. An exercise platform comprising:

a front end;

a rear end;

an exercise surface that extends substantially between the front end and the rear end;

one or more lifting mechanisms configured to adjust an orientation of the exercise surface about a pivot point positioned between the front end and the rear end, wherein the one or more lifting mechanisms comprise:

a first motor;

a first connector operatively connecting the first motor to a first portion of the exercise platform adjacent the front end;

a second motor; and a second connector operatively connecting the second motor to a second portion of the exercise platform adjacent the rear end; and computing hardware configured to control each of the first motor and the second motor to adjust a length of the first connector and the second connector to adjust the orientation of the exercise surface about the pivot point, wherein each of the first connector and the second connector comprise at least one of a chain or a cable.

16. The exercise platform of claim 15, wherein the pivot point is disposed in a position comprising at least one of centrally along a length defined by the exercise platform; one third along the length, or two-thirds along the length.

17. The exercise platform of claim 15, wherein:

the first connector operatively connects the first motor to the first portion of the treadmill via at least one rotating connector;

the at least one rotating connector comprises at least one of a sprocket or a pulley.

18. The exercise platform of claim 15, wherein the exercise platform comprises at least one of a rowing machine, a treadmill, a bicycle, a Jacob's ladder, or a climbing wall.

19. The exercise platform of claim 15, wherein the computing hardware is further configured to automatically adjust the orientation of the running exercise surface about the pivot point in response to a particular stimulus.

20. A treadmill comprising:

a front end;

a rear end;

a belt defining a running surface that extends substantially between the front end and the rear end;

one or more lifting mechanisms configured to adjust an orientation of the running surface about a pivot point positioned centrally between the front end and the rear end; and computing hardware configured to control the one or more lifting mechanisms to adjust an incline level of the running surface about the pivot point, wherein the one or more lifting mechanisms comprise at least one lifting bag disposed beneath the treadmill configured to expand and contract to adjust the incline level of the running surface.

* * * * *